US010071569B2

(12) United States Patent
Ochi et al.

(10) Patent No.: US 10,071,569 B2
(45) Date of Patent: Sep. 11, 2018

(54) PRINTER AND METHOD FOR MANUFACTURING PRINTED MATERIAL

(71) Applicant: MIMAKI ENGINEERING CO., LTD., Nagano (JP)

(72) Inventors: Kazuhiro Ochi, Nagano (JP); Eiichi Ohara, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/508,108

(22) PCT Filed: Sep. 4, 2015

(86) PCT No.: PCT/JP2015/075247
§ 371 (c)(1),
(2) Date: Mar. 2, 2017

(87) PCT Pub. No.: WO2016/035890
PCT Pub. Date: Mar. 10, 2016

(65) Prior Publication Data

US 2017/0282540 A1 Oct. 5, 2017

(30) Foreign Application Priority Data

Sep. 5, 2014 (JP) ..... 2014-181745

(51) Int. Cl.
*B41J 2/21* (2006.01)
*B41J 11/00* (2006.01)
(Continued)

(52) U.S. Cl.
CPC ..... *B41J 11/002* (2013.01); *B41J 2/15* (2013.01); *B41J 2/21* (2013.01); *B41J 2/2107* (2013.01);
(Continued)

(58) Field of Classification Search
CPC .... B41J 2/155; B41J 2/14016; B41J 2/14145; B41J 2/1404; B41J 2202/20
See application file for complete search history.

(56) References Cited

U.S. PATENT DOCUMENTS 6,170,931 B1 * 1/2001 Anderson ..... B41J 2/14072 347/17
6,331,055 B1 * 12/2001 Miller ..... B41J 2/1404 347/92
(Continued)

FOREIGN PATENT DOCUMENTS

JP 2011-037222 2/2011
JP 2012-250514 12/2012
JP 2013-215979 10/2013

OTHER PUBLICATIONS

"Office Action of China Counterpart Application," with English translation thereof, dated Aug. 22, 2017, p. 1-p. 17, in which the listed reference was cited.
(Continued)

*Primary Examiner* — Julian Huffman
(74) *Attorney, Agent, or Firm* — JCIPRNET

(57) ABSTRACT

In a printing method in which a base layer is formed with glossy ink or the like, a longer time period for drying the base layer is ensured. A metallic ink nozzle section, a superimposed colored ink nozzle section configured to discharge superimposed colored ink that is to be superimposed onto a metallic ink layer, and a non-superimposed colored ink nozzle section configured to discharge colored ink onto a position at which no metallic ink layer has been formed are provided. The non-superimposed colored ink nozzle section is interposed between the metallic ink nozzle section and the superimposed colored ink nozzle section.

9 Claims, 10 Drawing Sheets

(51) Int. Cl.
*B41J 2/15* (2006.01)
*B41J 19/14* (2006.01)

(52) U.S. Cl.
CPC ..... *B41J 2/2114* (2013.01); *B41J 2/2117* (2013.01); *B41J 19/147* (2013.01)

(56) References Cited

U.S. PATENT DOCUMENTS

| | | | | |
|---|---|---|---|---|
| 2002/0001020 | A1* | 1/2002 | Mrvos | B41J 2/14072 347/65 |
| 2006/0152547 | A1* | 7/2006 | Silverbrook | B41J 2/155 347/42 |
| 2009/0244137 | A1 | 10/2009 | Kakutani | |
| 2010/0302311 | A1* | 12/2010 | Blair | B41J 2/155 347/42 |
| 2011/0018917 | A1 | 1/2011 | Fujisawa et al. | |
| 2012/0169803 | A1 | 7/2012 | Takamura | |
| 2015/0197089 | A1* | 7/2015 | Karita | B41J 2/1433 347/30 |

OTHER PUBLICATIONS

"International Search Report (Form PCT/ISA/210)", dated Nov. 17, 2015, with English translation thereof, pp. 1-4.
"Search Report of European Counterpart Application," dated Jan. 29, 2018, p. 1-p. 7, in which the listed references were cited.

* cited by examiner

PRINTER AND METHOD FOR MANUFACTURING PRINTED MATERIAL

CROSS-REFERENCE TO RELATED APPLICATION

This application is a 371 application of the international PCT application Ser. No. PCT/JP2015/075247, filed on Sep. 04, 2015, which claims the priority benefit of Japan application no. 2014-181745, filed on Sep. 05, 2014. The entirety of each of the above mentioned patent applications is hereby incorporated by reference herein and made a part of this specification.

TECHNICAL FIELD

The present invention relates to a printer and a method for manufacturing a printed material.

BACKGROUND ART

Methods are known in which a base layer is formed on a printing medium, and then ink is discharged onto the base layer. It is also known that such a method is used to superimpose CMYK (C: Cyan, M: Magenta, Y: Yellow, and K: Black) ink, which is ink for use in color printing, and the like on glossy ink, so as to be able to express various metallic colors.

Patent Document 1 discloses a printer that includes: a unit nozzle group that is constituted by a plurality of nozzle holes, and in which a base-layer nozzle group for discharging glossy ink, and an image-layer nozzle group for discharging a colored ink are arranged side by side in a direction in which a head performs sub scanning.

CITATION LIST

Patent Document

Patent Document 1: JP 2012-250514A (published on Dec. 20, 2012)

SUMMARY

Technical Problem

However, in the technique disclosed in Patent Document 1, since the base-layer nozzle group and the image-layer nozzle group are adjacent to each other in the sub scanning direction, a time interval between formation of a base layer, and formation of an image layer on the base layer is short, and the base layer is not sufficiently dried.

Particularly, in cases where passes in which the head is moved bi-directionally are used, the image layer is formed immediately after the formation of the base layer, and thus the ink of the base layer is eroded by the ink of the image layer. As a result, the ink bleeds at an interface, and the image quality deteriorates.

The present invention was made in view of the above-described problems, and an object thereof is to provide a printer and a method for manufacturing a printed material that can ensure, in a printing method for forming a base layer with glossy ink or the like, a longer time period for drying the base layer than that in a conventional printing method.

Solution to Problem

That is, in order to solve the above-described problems, (1) a printer according to the present invention includes:

a head unit that is configured to move in a main scanning direction, and is provided with a plurality of ink discharging nozzles on a surface that faces a printing medium; and a movement controller that is configured to move at least one of the printing medium and the head unit so that the printing medium and the head unit move relatively to each other in a sub scanning direction that is orthogonal to the main scanning direction, wherein the plurality of ink discharging nozzles of the head unit are divided into at least:

a base ink nozzle section configured to discharge base ink for forming a base layer on the printing medium when the head unit moves in the main scanning direction;

a superimposed ink nozzle section configured to discharge superimposed ink that is to be superimposed on the base layer when the head unit passes above the base layer by moving in the main scanning direction; and a buffer section configured not to discharge ink onto the base layer when the head unit passes above the base layer by moving in the main scanning direction, and the base ink nozzle section, the superimposed ink nozzle section, and the buffer section are arranged such that the buffer section passes above the base layer before the superimposed ink nozzle section passes above the base layer.

According to the above-described configuration, after the base layer has been formed, no ink is discharged onto the base layer while the buffer section passes by a position facing the base layer, and thus the base layer can be dried during this time.

Furthermore, (2) in the inventive printer according to the aspect (1), the buffer section includes a non-superimposed ink nozzle section configured to discharge ink that is not to be superimposed on the base layer, and at least one of the superimposed ink nozzle section and the non-superimposed ink nozzle section is configured to discharge ink for forming an image.

As a result of the ink discharging nozzles that are used to faun an image on the printing medium being divided into the superimposed ink nozzle section for discharging superimposed ink, and the non-superimposed ink nozzle section for discharging non-superimposed ink, it is possible to separate a timing at which the superimposed ink is discharged onto the base layer, from a trimming at which the non-superimposed ink is discharged at a position at which no base layer has been formed.

Accordingly, it is possible to suppress deterioration of the image quality due to bleeding that may occur at a boundary between the ink that has been discharged from the superimposed ink nozzle section and has adhered to the base layer, and the ink that has been discharged from the non-superimposed ink nozzle section and has adhered to a position at which no base layer has been formed.

This is because, in the vicinity of the boundary, after the non-superimposed ink has been discharged, the printing medium is fed, and then the superimposed ink is discharged, and thus it is possible to ensure a time period for drying the non-superimposed ink. Therefore, the image formed according to the present invention has higher image quality in which bleeding is suppressed, than an image formed using ink that has been discharged from a conventional head unit in which a nozzle section for discharging superimposed ink and a nozzle section for discharging non-superimposed ink are not separated from each other.

Furthermore, (3) in the inventive printer according to the aspect (1) or (2), the base ink is glossy ink that contains glossy pigments and a solvent, the printer further includes a head controller configured to control ink discharge of the head unit, and the head controller controls discharge of the base ink such that dots of the base ink that has been discharged from the base ink nozzle section onto the printing medium come into contact with each other.

With such control, the dots of the base ink come into contact with each other to form a large dot, and the volume of the dot increases. Therefore, the amount of ink contained in the dot also increases. In this case, the volume of the dot increases proportionally, but the surface area increases by a smaller ratio. Accordingly, the surface area in which the ink (solvent) contained in the dot come into contact with air is reduced compared to a case where the dots are not in contact with each other, and thus the time period necessary for drying the ink is extended.

Accordingly, as a result of discharging ink so that dots come into contact with each other, the surface area in which the ink is in contact with air is reduced, and thus the time period necessary for drying (volatilizing) the ink is extended. Consequently, the pigments fixed to the printing medium are in a state in which they are aligned due to the orientation of the pigments. If the pigments are scale-shaped for example, the pigments are fixed to the printing medium in the shape of scales (in a planar shape).

Accordingly, the base ink for use in the present invention forms a base layer having excellent gloss due to a long time period in which the pigments are aligned.

Furthermore, (4) in the inventive printer according to any one of the aspects (1) to (3), the head controller controls discharge of the superimposed ink such that dots of the superimposed ink that has been discharged from the superimposed ink nozzle section onto the base layer do not come into contact with each other.

With such control, the dots do not come into contact with each other while the superimposed ink is discharged, and thus adjacent dots do not bleed, making it possible to improve the image quality. Furthermore, the surface area in which the ink is in contact with air is larger than in the case where the dots are in contact with each other, making it possible to reduce a time period needed for drying the ink. With this, the superimposed ink is unlikely to erode the base layer, and thus it is possible to improve the gloss of the base layer.

Furthermore, (5) in the inventive printer according to any one of the aspects (1) to (4), the head controller controls discharge of the superimposed ink and the base ink such that a recording density (duty) of the superimposed ink is lower than a recording density of the base ink.

With such control, printing is performed with a reduced recording density of the superimposed ink and an increased number of times of a main scan operation, even if the printing is performed at a given position with the same amount of the base ink and the superimposed ink. Accordingly, a time period in which the ink is dried can be ensured, and thus the image quality is improved compared to the case where the density of the superimposed ink is high. Furthermore, the superimposed ink is unlikely to erode the base ink of the base layer, and thus it is possible to improve the gloss of the base layer.

Furthermore, (6) in the inventive printer according to any one of the aspects (1) to (5), the buffer section includes: a non-discharging nozzle section configured not to discharge ink; and a non-superimposed ink nozzle section configured to discharge ink that is not to be superimposed on the base layer, and the non-discharging nozzle section is arranged to pass above the base layer before the superimposed ink nozzle section passes above the base layer.

With this, if a layer formed with the ink from the base ink nozzle section, and a layer formed with the ink from the non-superimposed ink nozzle section are adjacent to each other, the non-discharging nozzle section passes above the base layer before the non-superimposed ink nozzle section discharges the ink at the boundary between the layers. The base layer can be dried during this time. Also, since the non-superimposed ink is discharged at the boundary after the printing medium has been fed in the sub scanning direction, it is possible to suppress bleeding or blur that may occur at the boundary due to the undried base ink and non-superimposed ink coming into contact with each other, which deteriorates the image quality.

Furthermore, (7) in the inventive printer according to any one of the aspects (1) to (6), the non-discharging nozzle section is arranged to pass above the base layer between a time when the superimposed ink nozzle section passes above the base layer, and a time when the non-superimposed ink nozzle section passes above the base layer.

With this, even if a layer formed with the ink from the non-superimposed ink nozzle section, and a layer formed with the ink from the superimposed ink nozzle section are adjacent to each other, a time period for drying the ink that has been discharged from the non-superimposed ink nozzle section can be ensured until the superimposed ink nozzle section discharges the ink. Accordingly, it is possible to suppress the ink from bleeding at the boundary between the layer formed with the ink from the non-superimposed ink nozzle section, and the layer formed with the ink from the superimposed ink nozzle section, which deteriorates the image quality.

(8) In the inventive printer according to any one of the aspects (1) to (7), the number of ink discharging nozzles of the base ink nozzle section that are included in the main scanning direction is smaller than the number of ink discharging nozzles of the superimposed ink nozzle section that are included in the main scanning direction.

By reducing the area of the base ink nozzle section while maintaining the number of nozzle holes of the base ink nozzle section and the superimposed ink nozzle section from which the respective types of ink are to be discharged, it is possible to increase the area of the superimposed ink nozzle section in accordance with this reduction. Accordingly, it is possible to increase the recording density of the base ink, and decrease the recording density of the superimposed ink.

(9) In the inventive printer according to any one of the aspects (1) to (8), the base ink nozzle section and the superimposed ink nozzle section of the head unit are set to be offset in the sub scanning direction, and the head controller controls ink discharge of the head unit such that the base ink nozzle section discharges the base ink at the same time as the superimposed ink nozzle section discharges the superimposed ink.

As a result of the base ink nozzle section and the superimposed ink nozzle section discharging the ink at the same time, it is possible to form an image using a recording method for stepwise recording a region with a plurality of passes (so-called "multi-pass method"), although the region is able to be recorded with one main scanning of the head unit. The image can achieve the good image quality without bands that may occur between adjacent scanning steps concentrating at one position (banding).

Furthermore, (10) a printing method according to the present invention relates to a printed material manufacturing method for manufacturing a printed material including:

discharging ink onto a printing medium from a plurality of ink discharging nozzles of a head unit that are provided on a surface that faces the printing medium, while the head unit moves in a main scanning direction, wherein the plurality of ink discharging nozzles are divided into at least:

a base ink nozzle section configured to discharge base ink for forming a base layer on the printing medium when the head unit moves in the main scanning direction;

a superimposed ink nozzle section configured to discharge superimposed ink that is to be superimposed on the base layer when the head unit passes above the base layer by moving in the main scanning direction; and a buffer section configured not to discharge ink onto the base layer when the head unit passes above the base layer by moving in the main scanning direction, and the buffer section passes above the base layer before the superimposed ink nozzle section passes above the base layer.

According to the above-described configuration, after the base layer has been formed, no ink is discharged onto the base layer while the buffer section passes by a position facing the base layer, and thus the base layer can be dried during this time.

Advantageous Effects of Invention

According to the printer and the method for manufacturing a printed material of the present invention, it is possible to ensure a longer time period for drying a base layer.

DESCRIPTION OF EMBODIMENTS

<Embodiment 1>

Hereinafter, an embodiment of the present invention will be described in detail.

Figure 1:
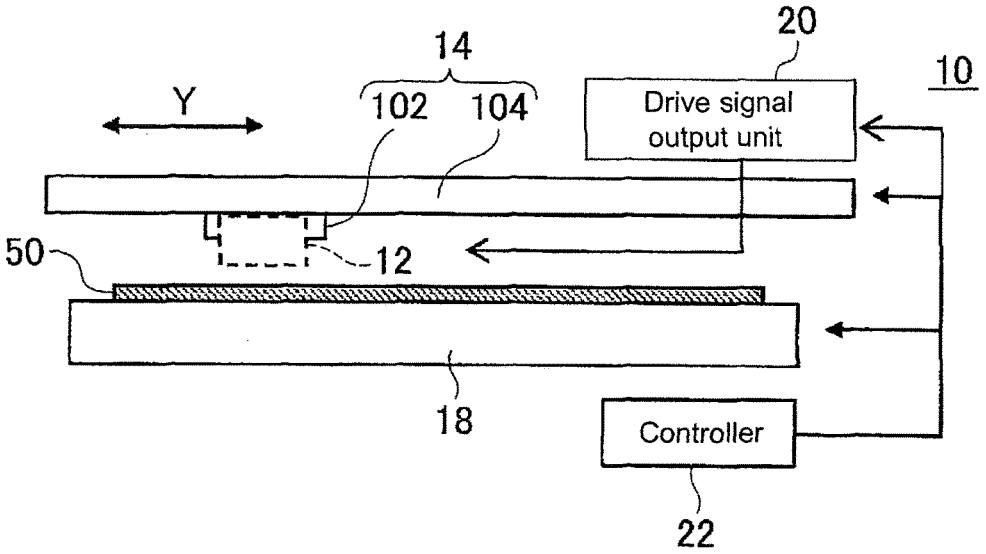
FIG. 1 is a front view illustrating a configuration of a main portion of a printer according to Embodiment 1 of the present invention.
Figure 2:
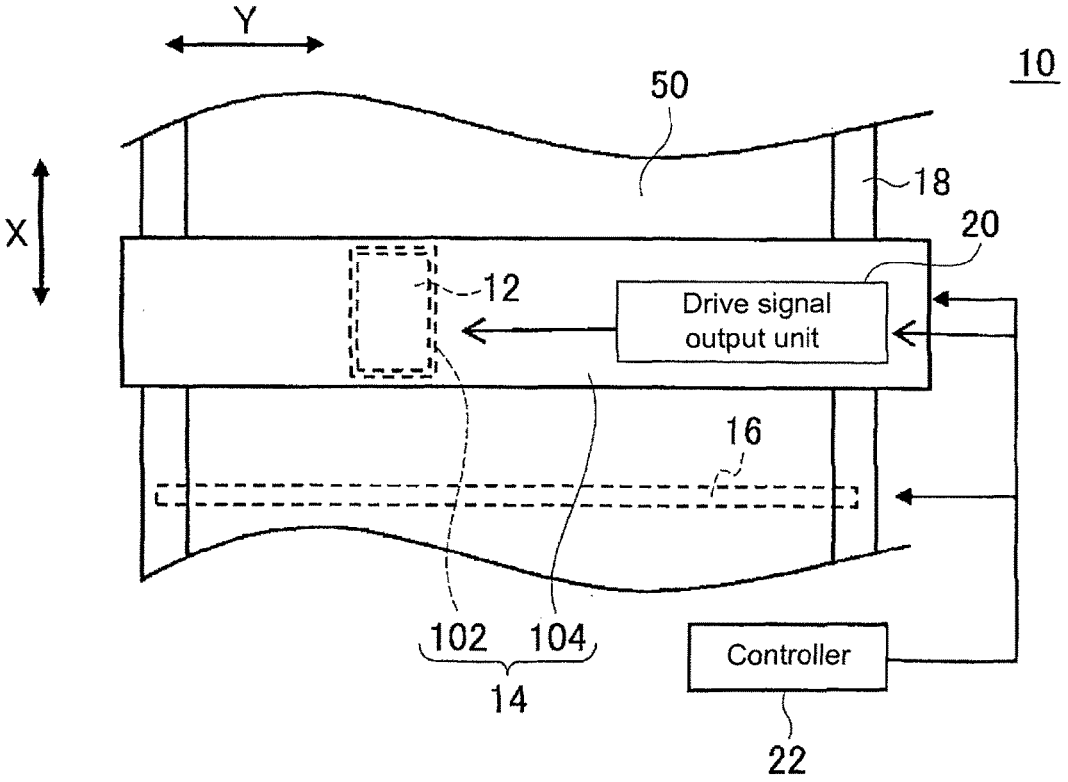
FIG. 2 is a top view illustrating an example of the configuration of the main portion of the printer according to Embodiment 1 of the present invention.

FIG. 1 and FIG. 2 show an example of a printer 10 according to an embodiment of the present invention. FIG. 1 is a front view illustrating an example of a configuration of the main portion of the printer 10, and FIG. 2 is a top view illustrating the example of the configuration of the main portion of the printer 10. Note that the printer 10 may have a configuration that is the same as or is similar to a well-known inkjet printer, except for the features to be described below.

The printer 10 is an inkjet printer that performs inkjet printing on a printing medium 50. Moreover, the printer 10 is, for example, an inkjet printer that performs serial printing by causing an inkjet head to perform a main scanning operation. The printer 10 includes a head unit 12, a main scanning driving unit 14, a sub scanning driving unit 16, a platen 18, a drive signal output unit 20, and a controller (a head controller and a movement controller) 22.

[Head Unit 12]

The head unit 12 is a portion for discharging ink onto the printing medium 50 so as to form, on the printing medium 50, dots of the ink that correspond to pixels of an image to be printed, in accordance with an instruction of the controller 22.

[Main Scanning Driving Unit 14]

The main scanning driving unit 14 is configured to cause the head unit 12 to perform a main scanning operation. In this case, "main scanning operation" refers to an operation of moving in, for example, a pre-set main scanning direction (Y direction in FIG. 1 and FIG. 2).

In the present embodiment, the main scanning driving unit 14 includes a carriage 102 and a guide rail 104. The carriage 102 holds the head unit 12 in a state in which nozzle rows of the head unit 12 face the printing medium 50. The guide rail 104 is a rail that guides the movement of the carriage 102 in the main scanning direction, and moves the carriage 102 in the main scanning direction in accordance with an instruction of the controller 22.

Here, an operation (main scanning operation) of the head moving "from one end to the other end" or "from the other end to one end" in the main scanning direction during an image formation process is referred to as a "pass", and one pass refers to one such operation (in which, for example, "the head moves once from one end to the other end").

Furthermore, an operation (sub scanning operation) for feeding the printing medium in a direction (sub scanning direction) that is orthogonal to the main scanning direction in order to determine a position at which ink is to be discharged in the next pass is performed between the end of one pass and the start of the next pass. Accordingly, an image is formed in a process in which one pass and one sub scanning operation are alternately repeated.

Furthermore, this image formation process can be performed in:

a case where printing is performed only with one-directional passes (the head discharges ink while repeating "one-way" passes in which it always moves "from one end to the other end"); and a case where printing is performed with bi-directional passes (the head discharges ink in passes moving "from one end to the other end" and in passes moving "from the other end to one end") (in reciprocation).

The present invention is described taking the case where an image is formed with bi-directional passes as an example.

[Sub Scanning Driving Unit 16]

The sub scanning driving unit 16 is configured to subject the printing medium 50 to a sub scanning operation. In this case, "sub scanning operation" refers to an operation of feeding the printing medium 50 from an upstream side to a downstream side by a predetermined distance in the sub scanning direction, which is orthogonal to the main scanning direction.

Furthermore, in the present embodiment, the sub scanning driving unit 16 is a roller that feeds the printing medium 50, and feeds the printing medium 50 from the upstream side to the downstream side by a predetermined distance in the sub scanning direction by rotating for a predetermined angle during the main scanning operation in accordance with an instruction of the controller 22.

Note that the printer 10 may also have a configuration in which, for example, the sub scanning operation is performed while, instead of the printing medium 50 being fed, the head unit 12 is moved relative to the printing medium 50 that is fixed in a position (as in an X-Y table machine, for example). In this case, a driving unit that moves, for example, the guide rail 104 in the sub scanning direction to move the head unit 12, or the like may be used as the sub scanning driving unit 16.

[Platen 18]

The platen 18 is a platform-shaped member on which the printing medium 50 is placed, and supports the printing medium 50 so that it faces a nozzle surface of the head unit 12. Furthermore, in the present embodiment, the platen 18 includes, at a position facing the head unit 12 for example, a heater for heating ink on the printing medium 50. This heater is a heating means for fixing ink on the printing medium 50 to the printing medium 50, and volatilizes and removes an ink medium (solvent) on the printing medium 50 by heating the ink on the printing medium 50. The platen 18 may include a plurality of heaters. For example, a heater (pre-heater) that heats the printing medium 50 in advance before ink drops are adhered thereto, and a heater (platen heater) that heats ink on the printing medium 50 at a position facing the head unit 12 may be included. Furthermore, for example, a heater (after-heater) that heats the ink on the printing medium 50 on the downstream side, in a direction in which the printing medium 50 is fed, relative to the head unit 12, or the like may further be included as well.

[Drive Signal Output Unit 20]

The drive signal output unit 20 is a signal output unit that outputs a driving signal to the head unit 12. In this case, "driving signal" refers to, for example, a signal that controls an operation of driving elements (for example, piezo-elements) that are arranged at the positions of the nozzles in the head unit 12. Furthermore, by controlling the operation of the driving element during the sub scanning operation, the drive signal output unit 20 causes the head unit 12 to discharge ink drops from the nozzle surface.

[Controller 22]

The controller 22 is a unit for controlling ink discharge of the head unit 12. For example, the controller 22 is a CPU (Central Processing Unit) of the printer 10, and controls the head unit 12 in accordance with instructions of a host PC (Personal Computer). Furthermore, the present embodiment is described assuming that the controller 22 controls operations of not only the head unit 12 but also the other components of the printer 10. Furthermore, the controller 22 performs control such that the printing medium 50 is moved in the direction (X direction in FIG. 2: sub scanning direction) that is orthogonal to the main scanning direction.

Note that the configuration of the movement controller that is provided in the printer according to the present invention is not limited to a configuration that moves a printing medium, and may be any configuration as long as it moves at least either of the printing medium or the head unit so that the printing medium and the head unit move relatively to each other in the direction (X direction in FIG. 2: sub scanning direction) that is orthogonal to the main scanning direction.

With the above-described configuration, the printer 10 performs printing on the printing medium 50.

[Details of Head Unit 12]

Figure 3:
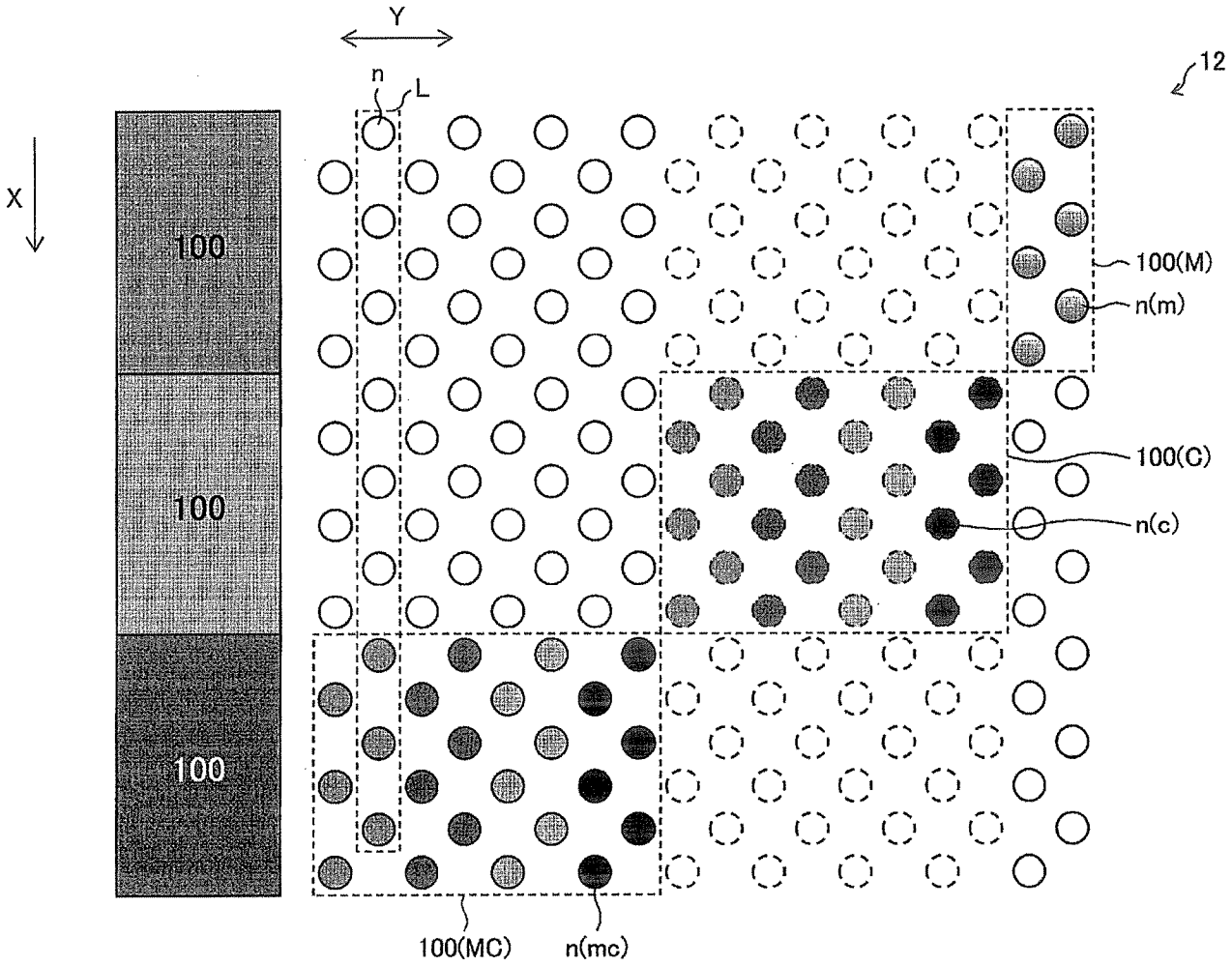
FIG. 3 is a diagram schematically illustrating a configuration of nozzles of a head unit provided in the printer according to Embodiment 1 of the present invention.

The following will describe a more specific configuration of the head unit 12 in detail with reference to FIG. 3. FIG. 3 is a diagram schematically illustrating a configuration of the nozzles of the head unit 12 provided in the printer 10.

As shown in FIG. 3, the head unit 12 includes a plurality of nozzle rows L that are arranged in the main scanning direction (Y direction), each nozzle row being constituted by a plurality of nozzle holes (nozzles) n lined up in the sub scanning direction (X direction). Note that the plurality of nozzle holes n that constitute a nozzle row L discharge ink of the same color.

The plurality of nozzle holes n that are arranged in the head unit 12 constitute a metallic ink nozzle section (base ink nozzle section) 100(M), a non-superimposed colored ink nozzle section (buffer section, non-superimposed ink nozzle section) 100(C), and a superimposed colored ink nozzle section (superimposed ink nozzle section) 100(MC).

The metallic ink nozzle section 100(M), the non-superimposed colored ink nozzle section 100(C), and the superimposed colored ink nozzle section 100(MC) are obtained by dividing the nozzle surface of the head unit 12 that has the plurality of nozzle holes n into a plurality of areas in the sub scanning direction (X direction).

(Metallic Ink Nozzle Section 100(M))

The metallic ink nozzle section 100(M) is a nozzle section for discharging metallic ink. The metallic ink forms, on the printing medium 50, a metallic ink layer (base layer), which serves as a base for superimposed colored ink.

Here, the present embodiment describes a case in which the metallic ink is used as base ink.

Metallic ink is an example of glossy ink, and is one type of base ink for use in the printer 10 according to the present invention.

"Glossy ink" refers to ink that is glossy, that is, ink that contains glossy pigments and a solvent. Examples of glossy pigments include pigments that contain metal such as aluminum, gold, silver, or brass, or an alloy thereof. Furthermore, the pigments may be, for example, scale-shaped so as to reflect light. Furthermore, the glossy ink may also be, for example, pearl-colored ink or the like.

Furthermore, the metallic ink may be, for example, a well-known metallic ink. For example, the metallic ink may be ink that contains scale-shaped pigments for a metallic color, and an organic solvent. This organic solvent may be a volatile organic solvent. Furthermore, this organic solvent is, for example, a medium that serves as a main component of the metallic ink. In this case, the main component of the ink refers to, for example, a component that constitutes at least 50% of the weight of the ink. For example, a glycol ether series solvent or the like may preferably be used as the organic solvent. The metallic ink may further include, for example, a binder resin or the like. Furthermore, the metallic ink may be, for example, silver-colored ink. In this case, the metallic ink may contain, for example, pigments of metal such as aluminum. Moreover, it is also conceivable that, for example, solvent UV ink is used as the metallic ink.

The present embodiment describes a case in which metallic ink is used as the base ink, but the base ink that is used in the present invention is not limited to metallic ink. Instead of metallic ink, for example, glossy ink may be used, or white ink or colored ink for whitening the base or coloring the base in a desired color may be used. The base ink can be suitably selected depending on a target base, and any type of base ink can ensure a longer drying time based on the present invention. Therefore, for example, if glossy ink is used as the base ink, the glossy ink can express excellent gloss, whereas if white ink or colored ink is used as the base ink, the white ink or the colored ink can be prevented from being mixed with superimposed ink.

The non-superimposed colored ink nozzle section 100(C) is a nozzle section for discharging colored ink that is not to be superimposed on the metallic ink layer. Furthermore, the ink discharged from the non-superimposed colored ink nozzle section 100(C) farms an image at a position at which no metallic ink layer has been formed.

Note that, in the printer 10 according to the present invention, the superimposed ink nozzle section 100(MC) and the non-superimposed ink nozzle section 100(C) constitute an image-layer ink nozzle section, but the configuration in which these nozzle sections together form an image is not essential, and it is sufficient to appropriately form a nozzle section for forming an image depending on a desired image.

Various types of well-known ink may be used as the colored ink. The plurality of nozzle rows (or nozzle holes) of the non-superimposed colored ink nozzle section 100(C) may respectively discharge ink drops of solvent ink of, for example, cyan ink C, magenta ink M, yellow ink Y, and black ink K. In addition, the solvent ink may include light-cyan ink Lc and light-magenta ink Lm. In the non-superimposed colored ink nozzle section 100(C), the nozzle rows of the cyan ink, the magenta ink, the yellow ink, and the black ink are arranged in the stated order in the main scanning direction (Y direction).

Furthermore, solvent ink may be used as the colored ink. "Solvent ink" refers to, for example, ink that contains pigments and an organic solvent. This organic solvent may be a volatile organic solvent. Furthermore, solvent UV ink or the like may be used as the colored ink. "Solvent UV ink" refers to, for example, ink that contains an ultraviolet curable monomer or oligomer, and an organic solvent serving as a medium. Furthermore, the solvent UV ink may be ink that is obtained by diluting ultraviolet curable ink with an organic solvent.

The non-superimposed colored ink nozzle section 100(C) serves as one type of a buffer section provided in the printer 10 according to the present invention, and serves as one type of the non-superimposed ink nozzle section. The buffer section provided in the printer 10 according to the present invention is not limited to the nozzle section for discharging colored ink that is not to be superimposed on the metallic ink layer as in the present embodiment, and it is sufficient that the head unit 12 is provided with, at a position facing the metallic ink layer, a portion that does not discharge ink onto the metallic ink layer.

Examples of a specific configuration of the buffer section that is provided in the printer 10 according to the present invention include, in addition to the nozzle section for discharging ink onto a position at which no metallic ink layer has been formed as in the present embodiment, a nozzle section that does not discharge any ink at all, and a section having a region in which no nozzles are provided. Furthermore, it is also possible that a head for discharging metallic ink and a head for discharging ink to be superimposed are formed as separate members, and a gap (space) is provided between the heads, this gap serving as the buffer section. Any buffer sections can ensure a longer time period for drying the metallic ink.

(Superimposed Colored Ink Nozzle Section 100(MC))

The superimposed colored ink nozzle section 100(MC) is a nozzle section for discharging colored ink that is to be superimposed on the metallic ink layer. The ink discharged from the superimposed colored ink nozzle section 100(MC) forms an image on the metallic ink layer.

The colored ink that is discharged from the superimposed colored ink nozzle section 100(MC) can be set as appropriate depending on a target printed material. Furthermore, the same ink can be used as the ink that is discharged from the non-superimposed colored ink nozzle section 100(C).

The present embodiment describes a type of a nozzle section that discharges colored ink as the superimposed ink nozzle section provided in the printer 10 according to the present invention, but the present embodiment can employ various types of ink to be superimposed on the base ink layer.

Examples of a combination of the base ink and the superimposed ink include a combination of metallic ink and colored ink, a combination of metallic ink and clear ink, a combination of white ink and colored ink, a combination of white ink and metallic ink, a combination of while ink and clear ink, a combination of colored ink and clear ink, a combination of colored ink and metallic ink, and a combination of colored ink and white ink.

Here, "clear ink" refers to transparent ink that does not contain a colorant such as pigments and a dyestuff. For example, when the base layer itself has a desired color, superimposing the clear ink can enhance the gloss, and protect the base layer.

Note that, while a plurality of nozzle holes n(m) that constitute the metallic ink nozzle section 100(M), a plurality of nozzle holes n(mc) that constitute the superimposed colored ink nozzle section 100(MC), and a plurality of nozzle holes n(c) that constitute the non-superimposed colored ink nozzle section 100(C) move in the main scanning direction (Y direction in FIG. 2), ink is discharged at the same time from at least one of the nozzle holes n(m), at least one of the nozzle holes n(mc), and at least one of the nozzle holes n(c). Then, the nozzle sections 100 (M, MC, and C) move in the sub scanning direction (X direction) by a distance that is shorter than the width, in the sub scanning direction, of the nozzle section 100 (sub scanning operation). In this manner, as a result of the main scanning operation and the sub scanning operation being alternately repeated, a printed image is formed stepwise on the printing medium 50. The completed printed image is such that a superimposed colored ink layer is formed at least partially on the metallic ink layer, that is, a plurality of ink layers are stacked on top of each other.

In the present embodiment and embodiments below, an example in which the nozzle sections are mounted on one head is described, but the head unit provided in the printer 10 according to the present invention may have the base ink nozzle section, the superimposed ink nozzle section, and the buffer section provided on a plurality of heads. For example, the base ink nozzle section may be provided on one of the plurality of heads that are mounted in a staggered arrangement, the superimposed ink nozzle section may be provided on another of the heads, and the non-discharging nozzle section and/or the non-superimposed ink nozzle section may be provided on yet another of the heads. Alternatively, a plurality of types of nozzle sections may be provided on one head, and the remaining nozzle section(s) may be provided on another head.

(Operation of Head Unit 12)

Hereinafter, an operation of the head unit 12 will be described. Note that in FIG. 3, a band-shaped portion that is located to the left of the nozzle holes n and in which numeric values are indicated shows the recording density of ink that is discharged from the nozzle sections.

"Recording density (record duty)" refers to the number of dots of ink that are to be adhered to a unit area on the printing medium 50 in one pass. The recording density of the present embodiment is taken to be 100, and the recording density of another embodiment that will be described later is indicated as a value relative to the recording density of 100 of the present embodiment.

The following will first describe the positional relationship between the metallic ink nozzle section 100(M), the non-superimposed colored ink nozzle section 100(C), and the superimposed colored ink nozzle section 100(MC).

That is, a pass of the non-superimposed colored ink nozzle section 100(C) is interposed between a pass of the metallic ink nozzle section 100(M) and a pass of the superimposed colored ink nozzle section 100(MC) when one main scanning operation of the head unit 12 is carried out.

Specifically, a configuration is possible in which the metallic ink nozzle section 100(M) is arranged on the upstream side in the sub scanning direction (X direction), the superimposed colored ink nozzle section 100(MC) is arranged on the downstream side of the metallic ink nozzle section 100(M), and the non-superimposed colored ink nozzle section 100(C), serving as a buffer section, is arranged between the metallic ink nozzle section 100(M) and the superimposed colored ink nozzle section 100(MC).

The following will describe a case where printing is performed with such an arrangement, for example, by moving the head unit 12 bi-directionally in four passes (two reciprocations in the main scanning direction), that is, printing in a unit area on the printing medium 50 is completed with four passes of the metallic ink nozzle section 100(M), the non-superimposed colored ink nozzle section 100(C), and the superimposed colored ink nozzle section 100(MC).

(First Pass)

First, the head unit 12 discharges metallic ink from the metallic ink nozzle section 100(M) onto the printing medium 50 while performing a main scanning operation in the direction of an arrow Y, so as to form a metallic ink layer.

(Sub Scanning Operation)

Furthermore, at each pass of the head unit 12, the printing medium 50 is fed in the direction of an arrow X (sub scanning direction) by the length of the metallic ink nozzle section.

Furthermore, the controller 22 performs control such that the head unit 12 in the first pass discharges metallic ink so that dots of the metallic ink come into contact with each other.

In this case, discharging ink so that dots come into contact with each other prolongs a time period for volatilizing (drying) a solvent contained in the metallic ink. The reason is as follows. When the dots come into contact with each other to form a large dot, the amount of metallic ink contained in the dots increases. In this case, the volume of the dot increases proportionally, but the surface area increases by a smaller ratio. Accordingly, the surface area in which the metallic ink contained in the dot come into contact with air is reduced compared to a case where the dots are not in contact with each other, and thus the time period necessary for drying the metallic ink (solvent) is extended. As a result, the pigments fixed to the printing medium 50 are in a state in which they are aligned due to the orientation of the pigments. If the pigments are scale-shaped for example, the pigments are fixed to the printing medium 50 in the shape of scales (in a planar shape).

Accordingly, as a result of a longer time period being ensured for aligning the pigments, the metallic ink for use in the present invention serves as a metallic ink layer having excellent gloss.

(Second Pass)

The printing medium 50 is fed in the direction of the arrow X (sub scanning direction) by the length of the metallic ink nozzle section, and then a second pass is performed. With this, the non-superimposed colored ink nozzle section 100(C) moves above the metallic ink layer.

In this case, the non-superimposed colored ink nozzle section 100(C) does not discharge ink onto the metallic ink layer, but discharges predetermined ink onto positions at which no metallic ink layer has been formed. Therefore, a time period for drying the metallic ink is ensured during this time, and thus the gloss of the metallic ink layer is improved.

(Third Pass)

Then, the printing medium 50 is fed in the direction of the arrow X (sub scanning direction) by the length of the metallic ink nozzle section, and then a third pass is performed. With this, the superimposed colored ink nozzle section 100(MC) discharges ink while moving above the metallic ink layer.

In this case, the metallic ink layer has improved gloss since it could be dried during the second pass, and thus the quality of an image that is formed by superimposing colored ink thereon is excellent in terms of gloss.

Furthermore, the superimposed colored ink nozzle section 100(MC) is controlled by the controller 22 so as to discharge the superimposed colored ink without dots thereof coming into contact with each other. Since the dots do not come into contact with each other, the dots do not bleed, and thus it is possible to improve the quality of the image formed on the metallic ink layer. Furthermore, because the surface area in which the ink comes into contact with air is larger and the drying time period is shorter than in a case where the dots overlap each other, the superimposed colored ink is unlikely to erode the metallic ink layer. This makes it possible to improve the gloss of the metallic ink layer.

Furthermore, by dividing the nozzle section for discharging colored ink into the superimposed colored ink nozzle section 100(MC) and the non-superimposed colored ink nozzle section 100(C) as in the present embodiment, it is possible to separate a pass in which colored ink is to be discharged onto the metallic ink layer from a pass in which colored ink is to be discharged onto positions at which no metallic ink layer has been formed. Accordingly, it is possible to prevent bleeding that may occur at a boundary between the ink that has been discharged from the superimposed colored ink nozzle section 100(MC) and has adhered to the metallic ink layer, and the ink that has been discharged from the non-superimposed colored ink nozzle section 100(C) and has adhered to a position at which no metallic ink layer has been formed. In the vicinity of the boundary, after the ink has been discharged from the non-superimposed colored ink nozzle section 100(C), the printing medium 50 is fed, and then the ink is discharged from the superimposed colored ink nozzle section 100(MC). As a result, a drying time period can be ensured for the ink that has been discharged from the non-superimposed colored ink nozzle section 100(C) and has adhered to a position at which no metallic ink layer has been formed.

Accordingly, the printed image has higher image quality than in cases where a nozzle section for discharging superimposed ink and a nozzle section for discharging non-superimposed ink are not separated from each other.

(Conventional Example)

Figure 11:
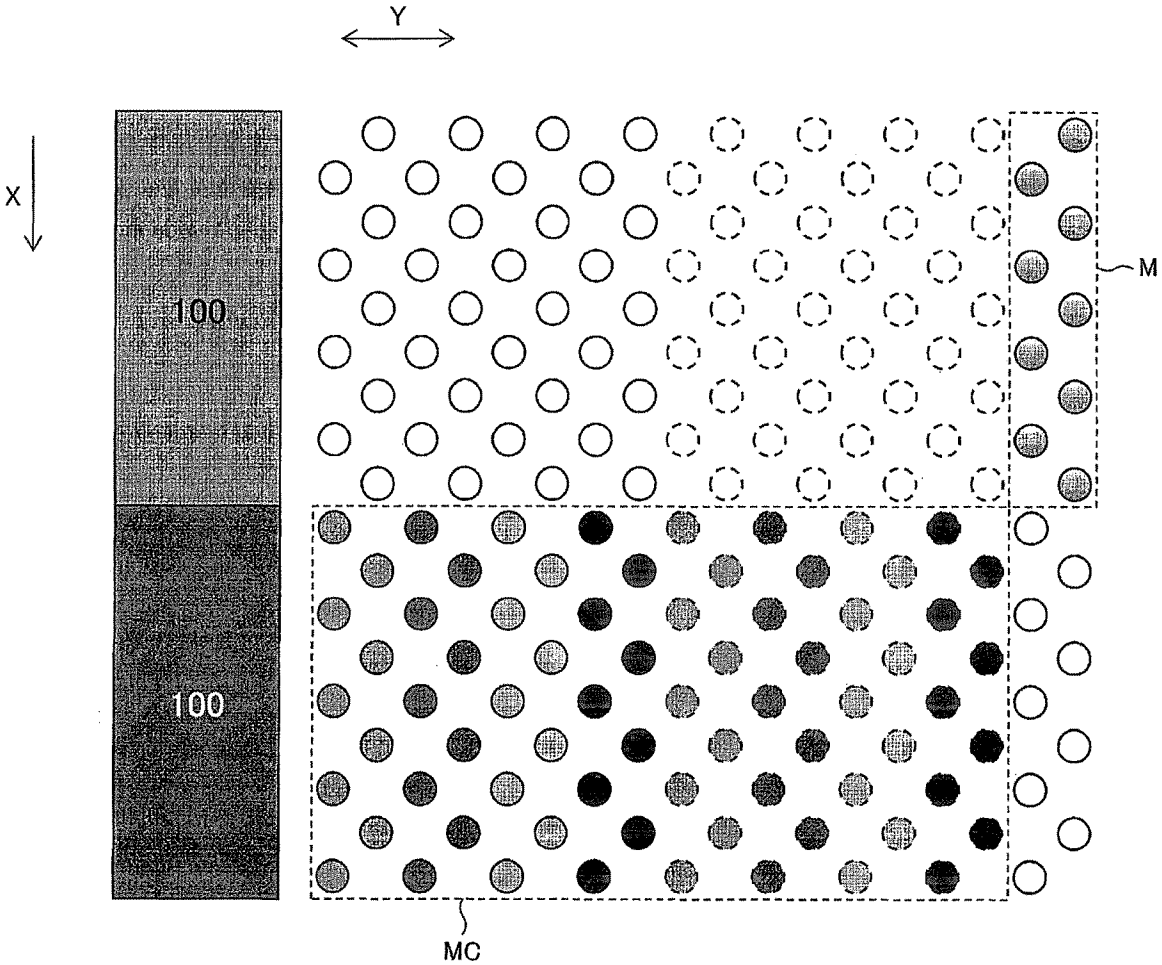
FIG. 11 (RELATED ART)
FIG. 11 is a diagram schematically illustrating a configuration of a nozzle section of a head according to a conventional example.

The following will describe an example of a configuration of a head according to a conventional technique with reference to FIG. 11. FIG. 11 is a diagram schematically illustrating a configuration of a nozzle section of a head according to a conventional example.

The head according to this conventional example includes a nozzle section M and a nozzle section MC. The nozzle section M is constituted by a plurality of nozzles for discharging metallic ink. The nozzle section MC is constituted by a plurality of nozzles for discharging colored ink that is to be superimposed on the metallic ink that has been discharged from the nozzle section M and has adhered to a printing medium.

No structure that corresponds to the buffer section provided in the printer 10 according to the present invention is provided between the nozzle section M and the nozzle section MC. Accordingly, the metallic ink is discharged onto the printing medium in a first pass, and then the colored ink is immediately superimposed on the metallic ink in a second pass. Accordingly, because a time period in which the metallic ink is dried cannot be ensured, pigments cannot be aligned, and thus the metallic ink layer has insufficient gloss.

<Embodiment 2>

Figure 4:
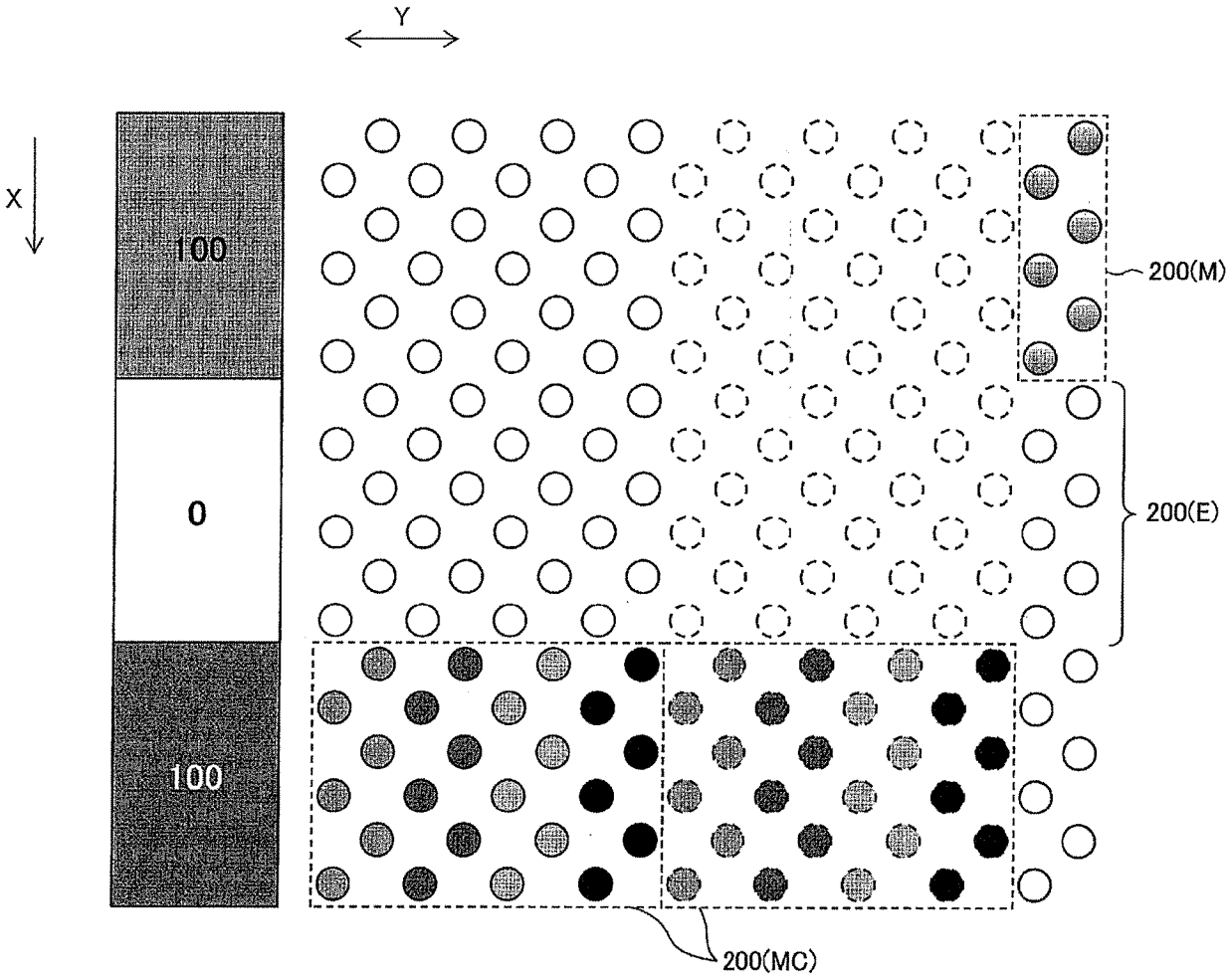
FIG. 4 is a diagram schematically illustrating a structure of another embodiment of the head unit provided in the printer according to the present invention.

The following will describe another embodiment of the head unit 12 provided in the printer 10 according to the present invention with reference to FIG. 4. FIG. 4 is a diagram schematically illustrating the structure of another embodiment of the head unit 12 provided in the printer 10 according to the present invention. Furthermore, in the present embodiment, differences from Embodiment 1 will be described, and thus, for convenience of description, descriptions of components that have the same functions as those of the components described in Embodiment 1 will be omitted.

The head unit 12 of the present embodiment includes a metallic ink nozzle section 200(M), a non-discharging nozzle section 200(E), and a superimposed colored ink nozzle section 200(MC).

(First Pass)

First, as a result of the head unit 12 performing a main scanning operation, metallic ink is discharged from the metallic ink nozzle section 200(M) onto the printing medium 50, and a metallic ink layer is formed.

(Second Pass)

Then, the printing medium 50 is fed in the direction of the arrow X (sub scanning direction) by the area of the metallic ink nozzle section 200(M), and then a second pass is performed. With this, the non-discharging nozzle section 200(E), serving as a buffer section, moves above the metallic ink layer.

In this case, because the non-discharging nozzle section 200(E) does not discharge ink onto the metallic ink layer, the time period for drying the metallic ink is ensured during this time, and thus the gloss of the metallic ink layer is improved.

(Third Pass)

Then, the printing medium 50 is fed in the direction of the arrow X (sub scanning direction) by the area of the metallic ink nozzle section, and then a third pass is performed. With this, the superimposed colored ink nozzle section 200(MC) discharges ink while moving above the metallic ink layer.

In this case, the metallic ink layer has improved gloss since it could be dried in the second pass, and thus an image that is formed by superimposing colored ink thereon also has excellent quality.

<Embodiment 3>

Figure 5:
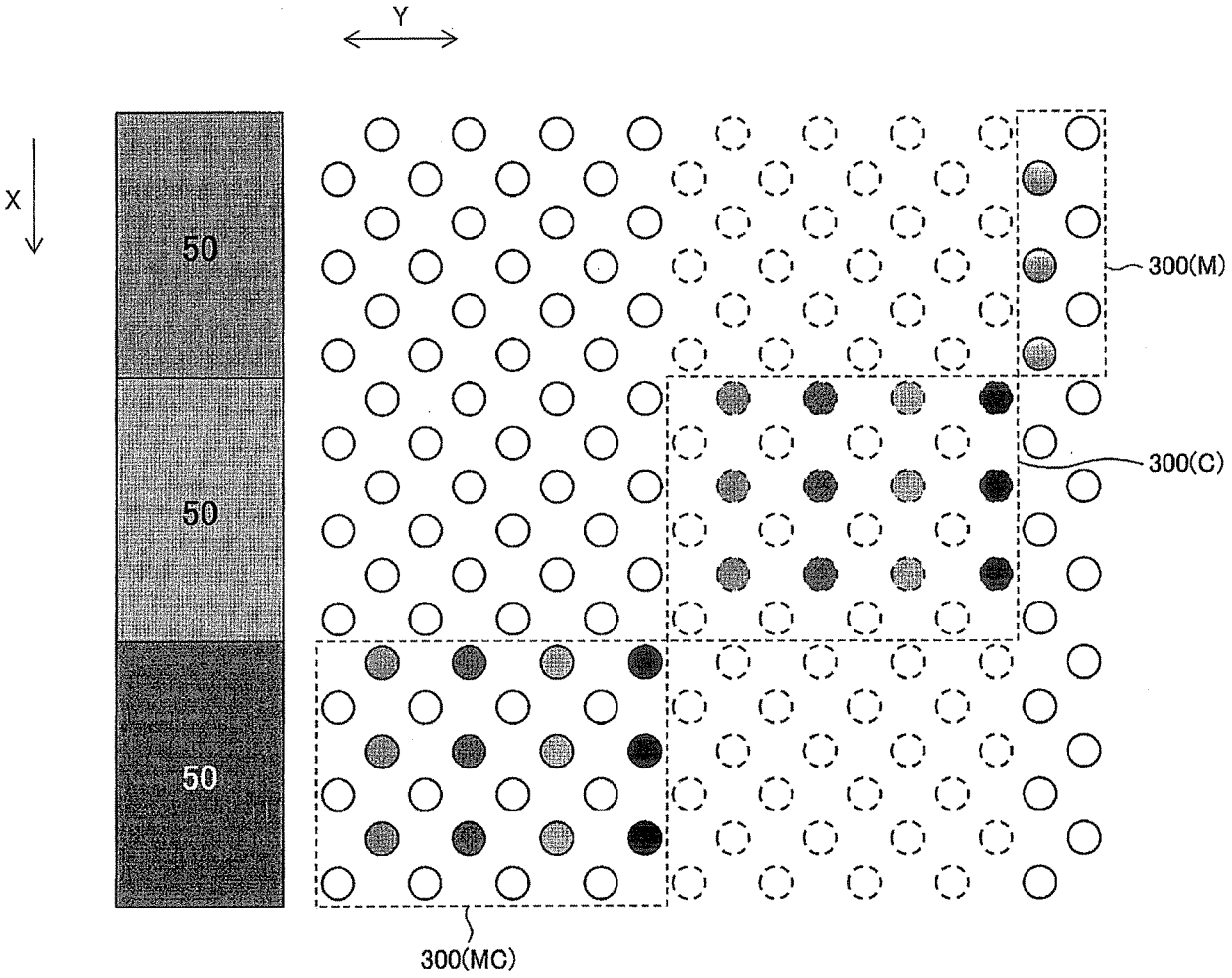
FIG. 5 is a diagram schematically illustrating a structure of another embodiment of the head unit provided in the printer according to the present invention.

The following will describe another embodiment of the head unit 12 provided in the printer 10 according to the present invention with reference to FIG. 5. FIG. 5 is a diagram schematically illustrating a structure of another embodiment of the head unit 12 provided in the printer 10 according to the present invention. Furthermore, in the present embodiment, differences from Embodiment 1 will be described, and thus, for convenience of description, descriptions of components that have the same functions as those of the components described in Embodiment 1 will be omitted.

The head unit 12 of the present embodiment includes a metallic ink nozzle section 300(M), a non-superimposed colored ink nozzle section 300(C), and a superimposed colored ink nozzle section 300(MC).

In the present embodiment, the recording density for printing using the nozzle sections is half as high as that of Embodiment 1. In other words, taking the recording density of Embodiment 1 as 100, the recording density of the present embodiment is 50.

Specifically, the recording density of ink is reduced by reducing the number of nozzle holes for use (for discharging ink) in one pass to half by mask processing while maintaining the areas of the nozzle sections. Note that the nozzle holes for use in the mask processing are not fixed, and suitably selected in the main scanning direction based on the mask processing.

(First Pass)

First, as a result of the head unit 12 performing a main scanning operation, metallic ink is discharged from the metallic ink nozzle section 300(M) onto the printing medium 50, and a metallic ink layer is formed.

In this case, the printing medium 50 is fed in the direction of the arrow X (sub scanning direction) by a predetermined distance, and then printing in the next pass is performed, in which the feeding distance in the direction of the arrow X (sub scanning direction) is set to a feeding distance that is half as long as that of Embodiment 1. With this, also the recording density for one pass is set to a recording density that is half as high as that of Embodiment 1. Accordingly, in order to achieve the same recording density for the printed material as that of Embodiment 1, the number of passes needs to be set to a number that is twice as large as that of Embodiment 1, and thus the printing time period is also twice as long as that of Embodiment 1.

(Second Pass)

Then, the printing medium 50 is fed in the direction of the arrow X (sub scanning direction) by a predetermined distance, and then a second pass is performed. With this, the non-superimposed colored ink nozzle section 300(C), serving as a buffer section, moves above the metallic ink layer.

In this case, because the non-superimposed colored ink nozzle section 300(C) does not discharge ink onto the metallic ink layer, the time period for drying the metallic ink is ensured during this time. Similar to the first pass, the feeding distance in the sub scanning direction for the non-superimposed colored ink nozzle section 300(C) is also half as long as that of Embodiment 1, and thus the number of passes necessary for printing is twice as large as that of Embodiment 1. In other words, the drying time period is twice as long as that of Embodiment 1, and thus a longer drying time period can be ensured.

(Third Pass)

Then, the printing medium 50 is fed in the direction of the arrow X (sub scanning direction) by a predetermined distance, and then a third pass is performed. With this, the superimposed colored ink nozzle section 300(MC) discharges ink while moving above the metallic ink layer.

In this case, since the metallic ink layer could be dried in the second pass, an image that is formed by superimposing colored ink thereon is prevented from bleeding for example, and due to the low recording density, the drying time period for the colored ink is also increased due to the increase in the number of passes, and thus the image formed by the colored ink has excellent quality.

<Embodiment 4>

Figure 6:
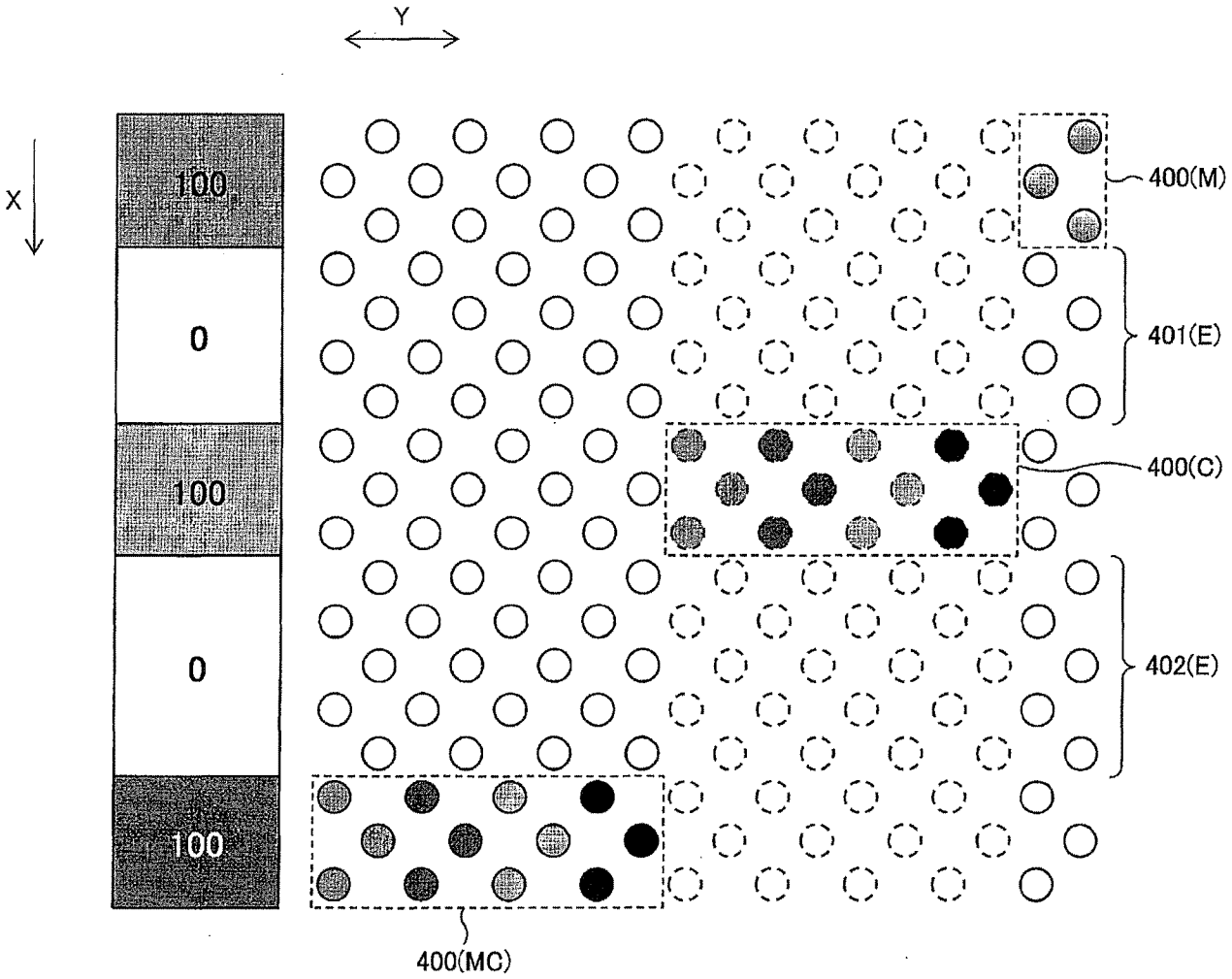
FIG. 6 is a diagram schematically illustrating a structure of another embodiment of the head unit provided in the printer according to the present invention.

The following will describe another embodiment of the head unit 12 provided in the printer 10 according to the present invention with reference to FIG. 6. FIG. 6 is a diagram schematically illustrating a structure of another embodiment of the head unit 12 provided in the printer 10 according to the present invention. Furthermore, in the present embodiment, differences from Embodiment 1 will be described, and thus, for convenience of description, descriptions of components that have the same functions as those of the components described in Embodiment 1 will be omitted.

The head unit 12 of the present embodiment includes a metallic ink nozzle section 400(M), a non-discharging nozzle section 401(E), a non-superimposed colored ink nozzle section 400(C), a non-discharging nozzle section 402(E), and a superimposed colored ink nozzle section 400(MC).

The recording density for the metallic ink nozzle section 400(M), the non-superimposed colored ink nozzle section 400(C), and the superimposed colored ink nozzle section 400(MC) is the same as that of Embodiment 1. Furthermore, the length, in the direction of the arrow X (sub scanning direction), of these nozzle sections is half as long as that of Embodiment 1.

Specifically, the metallic ink nozzle section 400(M) has only half the nozzle section area and half the number of nozzle holes compared to the metallic ink nozzle section 100(M), and uses an upstream area with respect to the direction in which the printing medium 50 is fed.

The non-superimposed colored ink nozzle section 400(C) has only half the nozzle section area and half the number of nozzle holes compared to the non-superimposed colored ink nozzle section 100(C), and uses a middle area with respect to the direction in which the printing medium 50 is fed.

The superimposed colored ink nozzle section 400(MC) has only half the nozzle section area and half the number of nozzle holes compared to the superimposed colored ink nozzle section 400(MC), and uses a downstream area in the direction with respect to which the printing medium 50 is fed.

Furthermore, the recording density is the same as that of Embodiment 1, but the area of the nozzles to be used is only half as large as that of Embodiment 1, and thus the feeding distance of the printing medium 50 in the direction of the arrow X (sub scanning direction) is reduced to half that of Embodiment 1.

(First Pass)

First, as a result of the head unit 12 performing a main scanning operation, metallic ink is discharged from the metallic ink nozzle section 400(M) onto the printing medium 50, and a metallic ink layer is formed.

(Second Pass)

Then, the printing medium 50 is fed in the direction of the arrow X (sub scanning direction) by the area of the metallic ink nozzle section 400(M), and then a second pass is performed. With this, the non-discharging nozzle section 401(E) moves above the metallic ink layer.

In this case, because the non-discharging nozzle section 401(E) does not discharge ink onto the metallic ink layer, the metallic ink is dried during this time.

(Third Pass)

Then, the printing medium 50 is fed in the direction of the arrow X (sub scanning direction) by the area of the metallic ink nozzle section 400(M), and then a third pass is performed. With this, the non-superimposed colored ink nozzle section 400(C) moves above the metallic ink layer.

In this case, the non-superimposed colored ink nozzle section 400(C) does not discharge ink onto the metallic ink layer, but discharges predetermined ink onto the printing medium 50 on which no metallic ink layer has been formed. Accordingly, the metallic ink is dried during this time.

(Fourth Pass)

Then, the printing medium 50 is fed in the direction of the arrow X (sub scanning direction) by the area of the metallic ink nozzle section 400(M), and then a fourth pass is performed. With this, the non-discharging nozzle section 402(E) moves above the metallic ink layer.

In this case, the non-discharging nozzle section 402(E) does not discharge ink onto the metallic ink layer, and thus the metallic ink is dried during this time.

(Fifth Pass)

Then, the printing medium 50 is fed in the direction of the arrow X (sub scanning direction) by the area of the metallic ink nozzle section 400(M), and then a fifth pass is performed. With this, the superimposed colored ink nozzle section 400(MC) discharges ink while moving above the metallic ink layer.

As described above, in the present embodiment, the non-discharging nozzle section 401(E), the non-superimposed colored ink nozzle section 400(C), and the non-discharging nozzle section 402(E) move above the metallic ink layer during a time period from the end of discharge of the metallic ink to the start of discharge of the superimposed colored ink. Furthermore, the feeding distance of the printing medium 50 in the direction of the arrow X (sub scanning direction) between the passes is reduced to half that of Embodiment 1, and the second pass, the third pass, and the fourth pass are interposed, as passes of a buffer section, between the end of discharge of the metallic ink (first pass) and the start of discharge of the superimposed colored ink onto the metallic ink layer (fifth pass). Accordingly, the second pass, the third pass, and the fourth pass function as the buffer section, and thus a time period for drying the metallic ink layer is ensured. In other words, the length of the buffer section is twice as long as that of Embodiment 1. Furthermore, the feeding distance of the printing medium 50 is half as long as that of Embodiment 1, and thus in the present embodiment, a time period for drying the metallic ink that is four times as long as the time period of the Embodiment 1 can be ensured. According to the present embodiment, it is thus possible to achieve a metallic ink layer with even better gloss.

Furthermore, in the present embodiment, the non-discharging nozzle section 402(E) (fourth pass) is provided between the non-superimposed colored ink nozzle section 400(C) (third pass) and the superimposed colored ink nozzle section 400(MC) (fifth pass). With this, even if a layer formed with ink from the non-superimposed colored ink nozzle section 400(C), and a layer formed with ink from the superimposed colored ink nozzle section 400(MC) are adjacent to each other, it is possible to ensure a time period for drying the ink discharged from the non-superimposed colored ink nozzle section 400(C) until the superimposed colored ink nozzle section 400(MC) discharges the ink. Accordingly, it is possible to suppress the ink from bleeding at the boundary between the layer formed with the ink from the non-superimposed colored ink nozzle section 400(C) and the layer formed with the ink from the superimposed colored ink nozzle section 400(MC), which deteriorates the image quality.

Furthermore, the non-discharging nozzle section 401(E) never discharges ink. Accordingly, if the metallic ink layer and the layer formed with the colored ink from the non-superimposed colored ink nozzle section 400(C) are adjacent to each other, the non-discharging nozzle section 401(E) passes above the position of the interface therebetween before the non-superimposed colored ink nozzle section 400(C) discharges the ink. The metallic ink layer can be dried during this time. Then, after the printing medium 50 has been fed, the ink is discharged to the boundary from the non-superimposed colored ink nozzle section 400(C), and thus it is possible to prevent the ink from bleeding at the boundary.

Note that, in the present embodiment, the area of the metallic ink nozzle section 400(M) is smaller than the area of the superimposed colored ink nozzle section 400(MC).

By reducing the area of the metallic ink nozzle section 400(M) while maintaining the numbers of nozzle holes of the metallic ink nozzle section 400(M) and the superimposed colored ink nozzle section 400(MC) from which the respective types of ink are to be discharged, it is possible to increase the area of the superimposed colored ink nozzle section 400(MC) in accordance with this reduction. Accordingly, it is easy to increase the recording density of the metallic ink, and to decrease the recording density of the superimposed colored ink.

<Embodiment 5>

Figure 7:
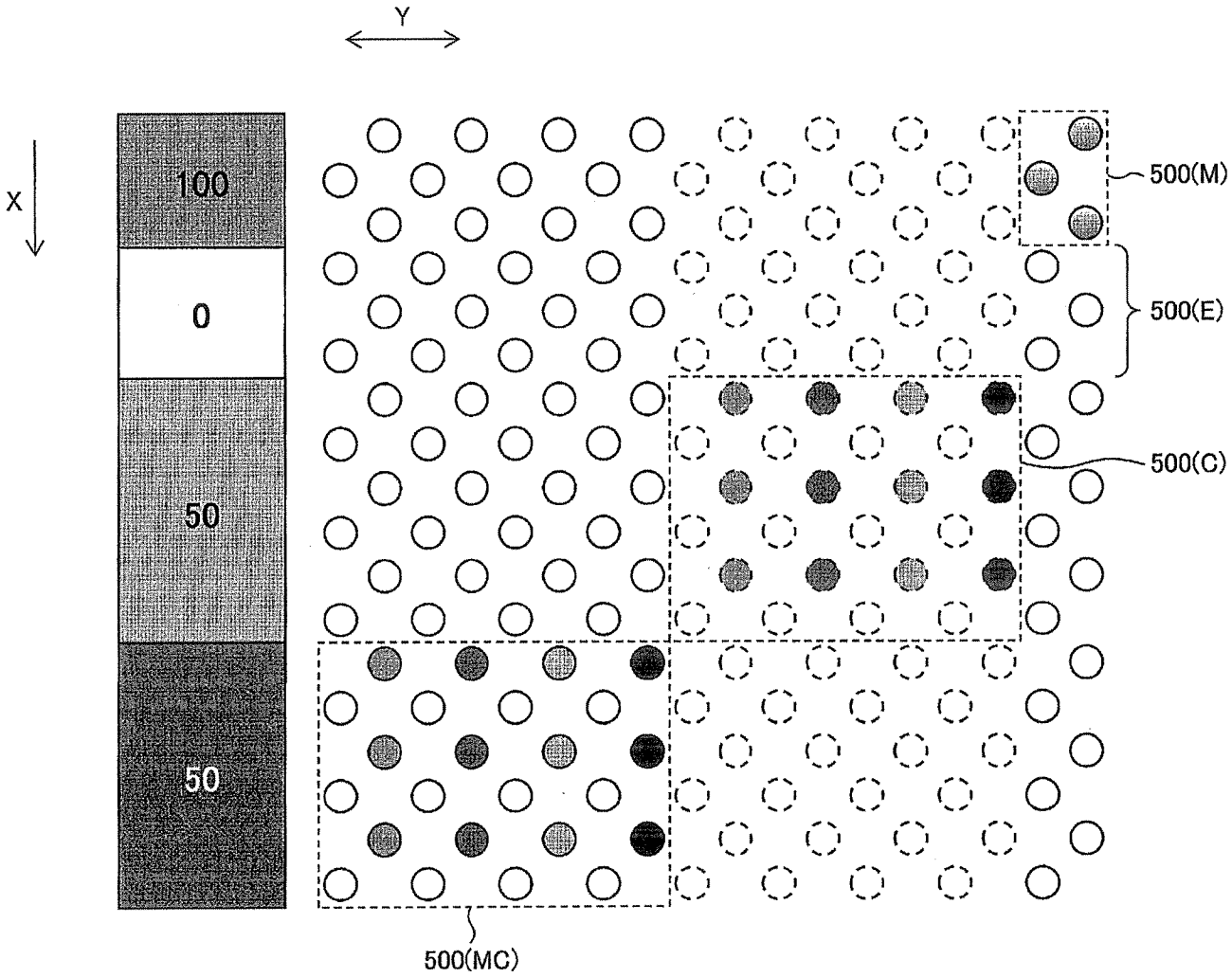
FIG. 7 is a diagram schematically illustrating a structure of another embodiment of the head unit provided in the printer according to the present invention.

The following will describe another embodiment of the head unit 12 provided in the printer 10 according to the present invention with reference to FIG. 7. FIG. 7 is a diagram schematically illustrating a structure of another embodiment of the head unit 12 provided in the printer 10 according to the present invention. Furthermore, in the present embodiment, differences from Embodiment 1 will be described, and thus, for convenience of description, descriptions of components that have the same functions as those of the components described in Embodiment 1 will be omitted.

The head unit 12 of the present embodiment includes a metallic ink nozzle section 500(M), a non-discharging nozzle section 500(E), a non-superimposed colored ink nozzle section 500(C), and a superimposed colored ink nozzle section 500(MC).

(First Pass)

First, as a result of the head unit 12 performing a main scanning operation, metallic ink is discharged from the metallic ink nozzle section 500(M) onto the printing medium 50, and a metallic ink layer is formed.

(Second Pass)

Then, the printing medium 50 is fed in the direction of the arrow X (sub scanning direction) by the area of the metallic ink nozzle section 500(M), and then a second pass is performed. With this, the non-discharging nozzle section 500(E), serving as a buffer section, moves above the metallic ink layer.

In this case, the non-discharging nozzle section 500(E) does not discharge ink onto the metallic ink layer, and thus the metallic ink is dried during this time.

(Third Pass)

Furthermore, the printing medium 50 is fed in the direction of the arrow X (sub scanning direction) by the area of the metallic ink nozzle section 500(M), and then a third pass is performed. With this, the non-superimposed colored ink nozzle section 500(C), serving as a buffer section, moves above the metallic ink layer.

In this case, the non-superimposed colored ink nozzle section 500(C) does not discharge ink onto the metallic ink layer, but discharges predetermined ink onto the printing medium 50 on which no metallic ink layer has been formed. Accordingly, the metallic ink is dried during this time.

(Fourth Pass)

Then, the printing medium 50 is fed in the direction of the arrow X (sub scanning direction) by the area of the metallic ink nozzle section 500(M), and then a fourth pass is performed. With this, the superimposed colored ink nozzle section 500(MC) discharges ink while moving above the metallic ink layer.

In the present embodiment, the recording density of the colored ink to be discharged from the superimposed colored ink nozzle section 500(MC) and the recording density of the colored ink to be discharged from the non-superimposed colored ink nozzle section 500(C) are half as high as that of Embodiment 1. Accordingly, similar to Embodiment 3, if the superimposed colored ink nozzle section 500(MC) and the non-superimposed colored ink nozzle section 500(C) attempt to form the same image as that in Embodiment 1, the feeding distance in the sub scanning direction X for the superimposed colored ink nozzle section 500(MC) and the non-superimposed colored ink nozzle section 500(C) is set to a feeding distance that is half as long as that of Embodiment 1, and thus the number of passes is set to a number that is twice as large as that of Embodiment 1.

Furthermore, the recording density of the metallic ink to be discharged from the metallic ink nozzle section 500(M) is the same as that of Embodiment 1, but, similar to Embodiment 4, the number of nozzle holes to be used is half as high as that of Embodiment 1. Specifically, the number of nozzle holes in the direction of the arrow X (sub scanning direction) is reduced to half the number of the metallic ink nozzle section 100(M) in Embodiment 1 while maintaining the area of the metallic ink nozzle section 500(M), and the remaining nozzle holes are used as the non-discharging nozzle section 500(E), which is provided between the metallic ink nozzle section 500(M) and the non-superimposed colored ink nozzle section 500(C). Accordingly, the length of the buffer section is increased by the length of the non-discharging nozzle section 500(E), and is 1.5 times as large as that of Embodiment 1.

As described above, since the number of passes is increased to a number that is twice as large as that of Embodiment 1 due to the recording density of the colored ink to be discharged from the superimposed colored ink nozzle section 500(MC) and the non-superimposed colored ink nozzle section 500(C), and the length of the buffer section is increased to a length that is 1.5 times as long as that of Embodiment 1 due to the length of the non-discharging nozzle section 500(E), a time period for drying the metallic ink layer is about three times as long as that of Embodiment 1, and the metallic ink layer has improved gloss.

Furthermore, control is performed such that the recording density for the superimposed colored ink nozzle section 500(MC) is lower than the recording density for the metallic ink nozzle section 500(M). In the present embodiment, the superimposed colored ink nozzle section 500(MC) is controlled by mask processing to have the recording density of 50, taking the recording density for the metallic ink nozzle section 500(M) as 100. Accordingly, if the amount of metallic ink to be used for printing at a given position, and the amount of colored ink to be superimposed thereon are equal to each other, reducing the recording density of the superimposed colored ink and increasing the number of passes for the superimposed colored ink improves the image quality. Furthermore, because the superimposed colored ink is unlikely to erode the metallic ink of the metallic ink layer, it is possible to improve the gloss of the metallic ink layer.

<Embodiment 6>

Figure 8:
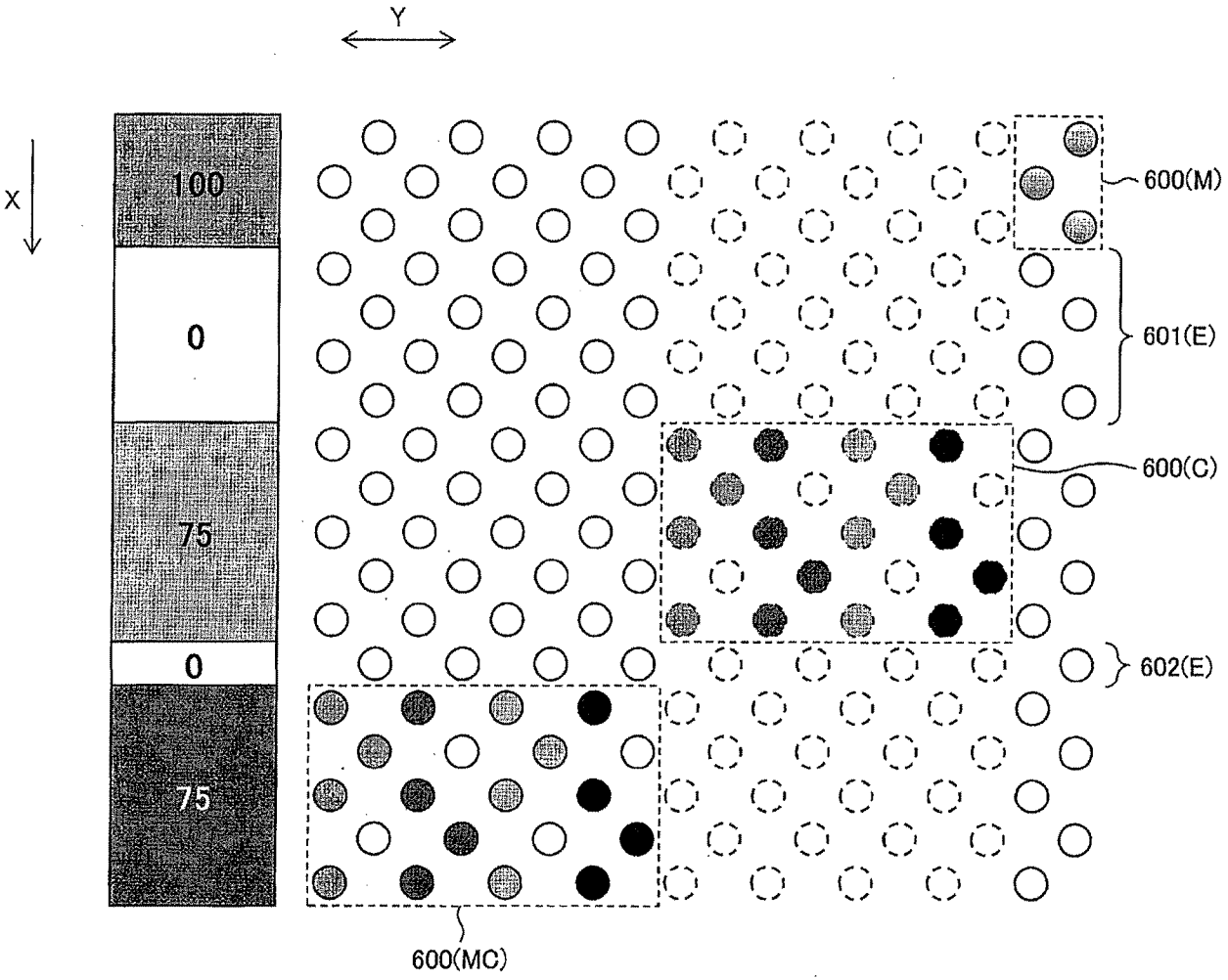
FIG. 8 is a diagram schematically illustrating a structure of another embodiment of the head unit provided in the printer according to the present invention.

The following will describe another embodiment of the head unit 12 provided in the printer 10 according to the present invention with reference to FIG. 8. FIG. 8 is a diagram schematically illustrating a structure of another embodiment of the head unit 12 provided in the printer 10 according to the present invention. Furthermore, in the present embodiment, differences from Embodiment 4 will be described, and thus, for convenience of description, descriptions of components that have the same functions as those of the components described in Embodiment 4 will be omitted.

The head unit 12 of the present embodiment includes a metallic ink nozzle section 600(M), a non-discharging nozzle section 601(E), a non-superimposed colored ink nozzle section 600(C), a non-discharging nozzle section 602(E), and a superimposed colored ink nozzle section 600(MC).

Embodiments 6 and 4 differ from each other in the recording density for the non-superimposed colored ink nozzle section 600(C) and the superimposed colored ink nozzle section 600(MC). Taking the recording density for the non-superimposed colored ink nozzle section 400(C) and the superimposed colored ink nozzle section 400(MC) as 100, the recording density for both the non-superimposed colored ink nozzle section 600(C) and the superimposed colored ink nozzle section 600(MC) is 75. And the length, in the X direction (sub scanning direction), of the nozzle sections is 1.5 times as long as that of Embodiment 4.

Because printing is performed at positions on the printing medium 50 with a recording density that is lower than that of Embodiment 4 and a number of passes that is larger than that of Embodiment 4, adhering dots are unlikely to be affected by other dots, for example, the outlines of the adhering dots do not tend to bleed or blur, and thus it is possible to improve the image quality relative to that of Embodiment 4.

Furthermore, in the present embodiment, there are a larger number of discharging nozzle holes than in Embodiment 4, and it is furthermore possible to select suitable discharging nozzle holes according to the mask processing. Accordingly, an image formed with colored ink has the reliable quality due to being unlikely to be affected by the inherent characteristics of the discharging nozzle holes (for example, the accuracy in the position at which ink is to be adhered).

Furthermore, the non-discharging nozzle section 602(E) is provided between the non-superimposed colored ink nozzle section 600(C) and the superimposed colored ink nozzle section 600(MC). Accordingly, due to the same reason as in Embodiment 4, it is possible to suppress ink bleeding at a boundary between a layer formed with ink from the non-superimposed colored ink nozzle section 600(C) and a layer formed with ink from the superimposed colored ink nozzle section 600(MC), which deteriorates the image quality.

Furthermore, in the present embodiment, control is performed such that the recording density for the superimposed colored ink nozzle section 600(MC) is lower than the recording density for the metallic ink nozzle section 600(M). In other words, the superimposed colored ink nozzle section 600(MC) is controlled by mask processing to have a recording density of 75, taking the recording density for the metallic ink nozzle section 600(M) as 100. Accordingly, due to the same reason as in Embodiment 4, it is possible to improve the image quality of the colored ink layer that is formed on the metallic ink layer.

<Embodiment 7>

Figure 9:
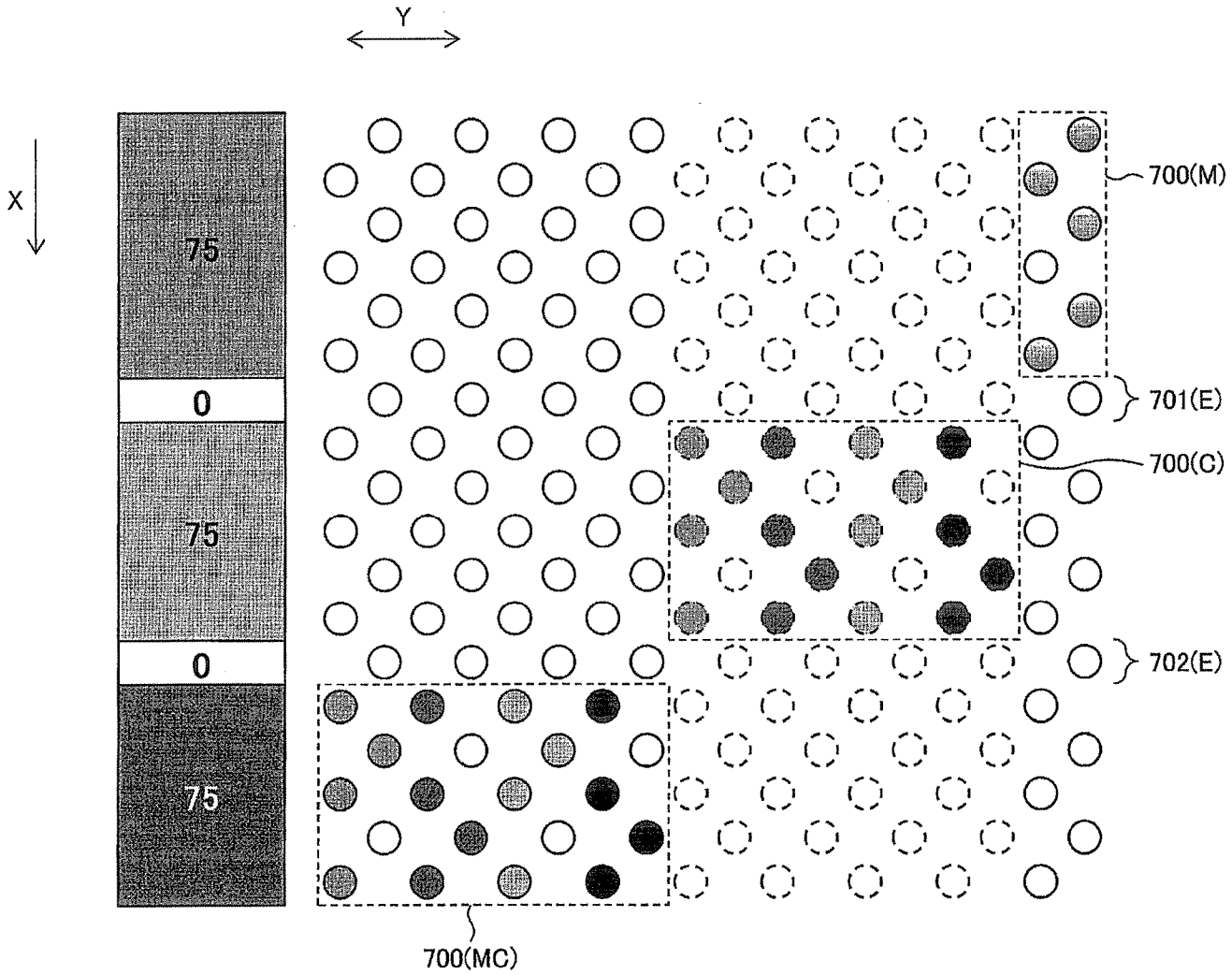
FIG. 9 is a diagram schematically illustrating a structure of another embodiment of the head unit provided in the printer according to the present invention.

The following will describe another embodiment of the head unit 12 provided in the printer 10 according to the present invention with reference to FIG. 9. FIG. 9 is a diagram schematically illustrating a structure of another embodiment of the head unit 12 provided in the printer 10 according to the present invention. Furthermore, in the present embodiment, differences from Embodiment 6 will be described, and thus, for convenience of description, descriptions of components that have the same functions as those of the components described in Embodiment 6 will be omitted.

The head unit 12 of the present embodiment includes a metallic ink nozzle section 700(M), a non-discharging nozzle section 701(E), a non-superimposed colored ink nozzle section 700(C), a non-discharging nozzle section 702(E), and a superimposed colored ink nozzle section 700(MC).

Embodiments 7 and 6 differ from each other in the recording density for the metallic ink nozzle section 700(M). Taking the recording density for the metallic ink nozzle section 600(M) as 100, the recording density for the metallic ink nozzle section 700(M) is 75.

Because printing is performed at a position on the printing medium 50 with a recording density that is lower than that of Embodiment 6 and a number of passes that is larger than that of Embodiment 6, a metallic ink layer with better image quality in which banding is suppressed compared to Embodiment 6 can be obtained.

Furthermore, in the present embodiment, similar to Embodiment 6, the feeding distance of the printing medium 50 is set to a feeding distance that is half as long as that of Embodiment 1 and the number of passes is set to a number that is twice as large as that of Embodiment 1.

Furthermore, the non-discharging nozzle section 702(E) is provided between the non-superimposed colored ink nozzle section 700(C) and the superimposed colored ink nozzle section 700(MC). Accordingly, due to the same reason as in Embodiment 4, it is possible to suppress ink bleed at a boundary between a layer formed with ink from the non-superimposed colored ink nozzle section 700(C) and a layer formed with ink from the superimposed colored ink nozzle section 700(MC), which deteriorates the image quality.

<Embodiment 8>

Figure 10:
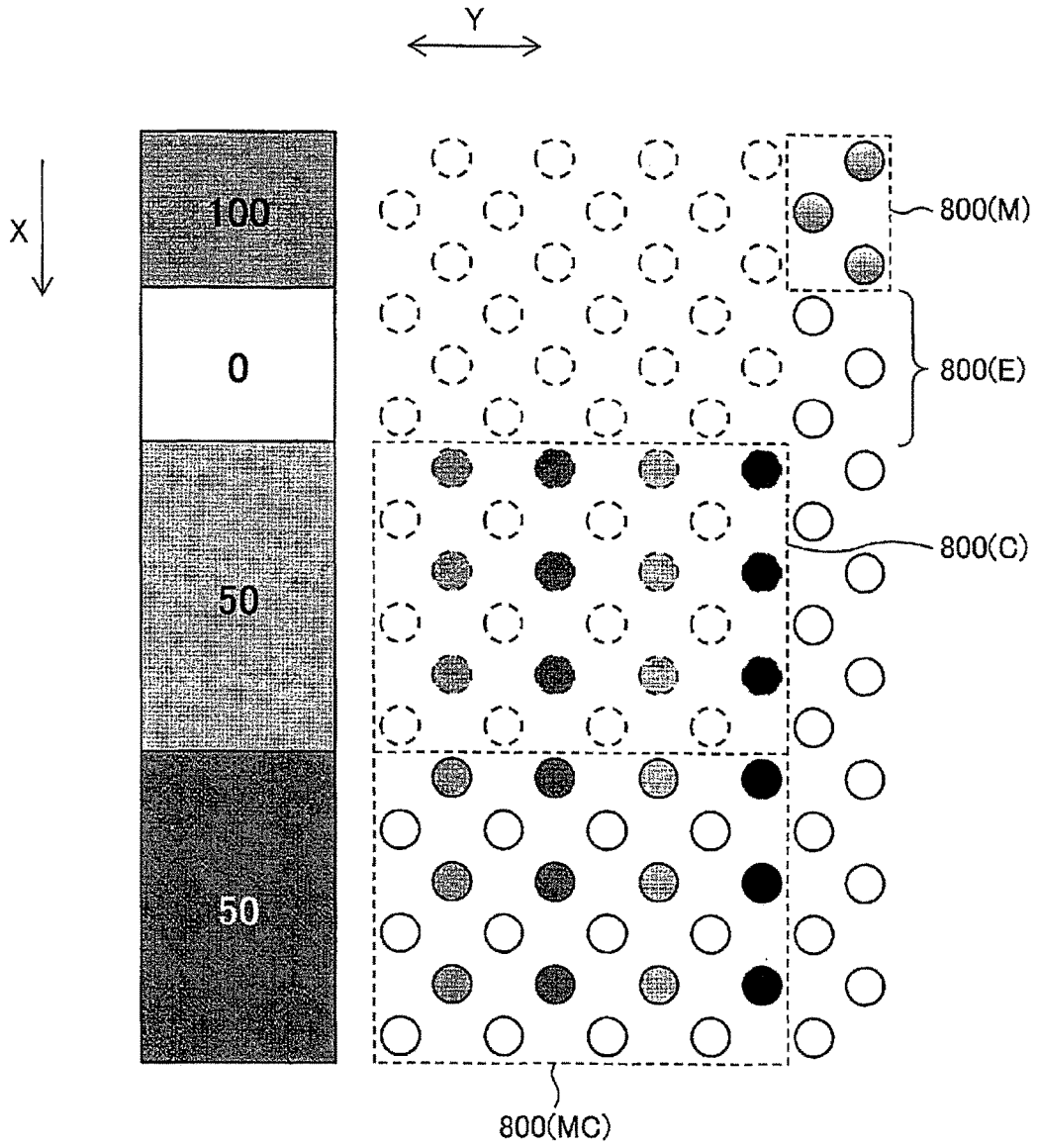
FIG. 10 is a diagram schematically illustrating a structure of another embodiment of the head unit provided in the printer according to the present invention.

The following will describe another embodiment of the head unit 12 provided in the printer 10 according to the present invention with reference to FIG. 10. FIG. 10 is a diagram schematically illustrating a structure of another embodiment of the head unit 12 provided in the printer 10 according to the present invention. Furthermore, in the present embodiment, differences from Embodiment 5 will be described, and thus, for convenience of description, descriptions of components that have the same functions as those of the components described in Embodiment 5 will be omitted.

The head unit 12 of the present embodiment includes a metallic ink nozzle section 800(M), a non-discharging nozzle section 800(E), a non-superimposed colored ink nozzle section 800(C), and a superimposed colored ink nozzle section 800(MC).

A difference from Embodiment 5 is present in that the non-superimposed colored ink nozzle section 800(C) and the superimposed colored ink nozzle section 800(MC) are arranged in the same nozzle rows. This embodiment can be applied when the non-superimposed colored ink nozzle section 800(C) and the superimposed colored ink nozzle section 800(MC) use the same ink (for example, YMCK colored ink).

By arranging the non-superimposed colored ink nozzle section 800(C) and the superimposed colored ink nozzle section 800(MC) in the same nozzle rows in this way, it is possible to reduce the number of nozzle rows of the head unit 12 for use, and other nozzle rows can be applied to another nozzle section (for example, the metallic ink nozzle section 800(M)). Accordingly, it is possible to efficiently use the nozzle rows of the head unit 12.

Note that also in the present embodiment, a metallic ink layer that has the same gloss, image quality, and the like as those of Embodiment 5 can be achieved.

[Example of Implementation Using Software]

The controller 22 may be implemented by a logic circuit (hardware) formed as an integrated circuit (integrated circuit (IC) chip) or the like. Alternatively, the controller 22 may be implemented by software using a central processing unit (CPU).

In the latter case, the controller 22 is provided with a CPU for executing instructions of a program, which is software for implementing various functions, a read only memory (ROM) or a storage device (which is referred to as "recording medium") in which the program and various types of data are stored so as to be readable by a computer (or the CPU), a random access memory (RAM) on which the program is to be expanded, and the like. Also, by the computer (or the CPU) reading the program from the recording medium and executing the read program, the object of the present invention is achieved. The recording medium may be a "non-transitory tangible medium", for example, a tape, a disk, a card, a semiconductor memory, a programmable logic circuit, or the like. Furthermore, the program may be supplied to the computer via any transmission medium (communication network, broadcast wave, or the like) that can transmit the program. Note that the present invention may be realized also in a form of data signals that are embedded in a carrier wave and in which the program is implemented by electronic transmission.

<Appendix>

As described above, the printer 10 is provided with the head unit 12 that moves in the main scanning direction (Y direction in FIG. 2) and discharges ink onto the printing medium 50, and the controller 22 that moves the printing medium 50 so that the printing medium 50 and the head unit 12 move relatively to each other in the direction (X direction in FIG. 2: sub scanning direction) that is orthogonal to the main scanning direction. The head unit 12 is provided with the metallic ink nozzle section 100(M) for discharging metallic ink for forming a metallic ink layer, the superimposed colored ink nozzle section 100(MC) that discharges superimposed colored ink to be superimposed on the metallic ink layer, and the non-superimposed colored ink nozzle section 100(C) that serves as a buffer section that does not discharge ink onto the metallic ink layer when the head unit 12 moving in the main scanning direction (Y direction in FIG. 2) passes above the metallic ink layer, and a pass of the non-superimposed colored ink nozzle section 100(C) is interposed between a pass of the metallic ink nozzle section 100(M) and a pass of the superimposed colored ink nozzle section 100(MC) that are involved with a main scanning operation of the head unit 12.

According to the above-described configuration, after the metallic ink layer has been formed, no ink is discharged onto the metallic ink layer while the non-superimposed colored ink nozzle section 100(C) passes by a position facing the metallic ink layer, and thus the metallic ink layer can be dried during this time.

Furthermore, the printer 10 includes, as the buffer section, the non-superimposed colored ink nozzle section 100(C) that discharges ink that is not to be superimposed on the metallic ink layer, and at least either of the superimposed colored ink nozzle section 100(MC) or the non-superimposed colored ink nozzle section 100(C) discharges ink for forming an image.

"Ink for forming an image" specifically refers to colored ink. By dividing the nozzle section for discharging colored ink into the superimposed colored ink nozzle section 100 (MC) and the non-superimposed colored ink nozzle section 100(C), it is possible to separate the pass in which colored ink is discharged onto the metallic ink layer, from the pass in which colored ink is discharged at a position at which no metallic ink layer has been formed. Accordingly, it is possible to suppress bleeding that may occur at a boundary between the superimposed colored ink and the non-superimposed colored ink. In the vicinity of the boundary, after the non-superimposed colored ink has been discharged, the printing medium 50 is fed, and then the superimposed colored ink is discharged, and thus it is possible to ensure a time period for drying the non-superimposed colored ink. Therefore, the image quality is further improved compared to an image foil led when the present embodiment is not applied.

Furthermore, in the printer 10, the base ink is metallic ink, and the controller 22 for controlling ink discharge of the head unit 12 is provided. The controller 22 performs control such that dots of the metallic ink that is discharged in one pass come into contact with each other.

If the metallic ink is discharged so that dots come into contact with each other, a time period for volatilizing a solvent contained in the metallic ink is prolonged. As a result, due to the orientation of pigments contained in the ink, the pigments can be in an aligned state. If the pigments are scale-shaped for example, the pigments are fixed to the printing medium in the shape of scales (in a planar shape).

Accordingly, as a result of ensuring a long time period for aligning the pigments, the metallic ink for use in the present invention can form a metallic ink layer having an excellent gloss.

Furthermore, in the printer 10, the controller 22 performs control such that dots of the superimposed colored ink that is discharged in one pass do not come into contact with each other.

Since the dots do not overlap each other, it is possible to improve the quality of an image formed on the metallic ink layer. Furthermore, since the superimposed colored ink is unlikely to erode the metallic ink layer, it is possible to improve the gloss of the metallic ink layer.

Furthermore, the controller 22 of the printer 10 according to the present invention performs control such that the recording density for the superimposed colored ink nozzle section 400(MC) is lower than the recording density for the metallic ink nozzle section 400(M).

Accordingly, even if printing is performed at a position with the same amount of the metallic ink and the superimposed colored ink, the image quality is improved by decreasing the density of the superimposed colored ink, and increasing the number of passes for the superimposed colored ink. Furthermore, since the superimposed colored ink is unlikely to erode the metallic ink of the metallic ink layer, it is possible to improve the gloss of the metallic ink layer.

Furthermore, the printer 10 is provided with the non-discharging nozzle section 500(E) that does not discharge ink, and the non-superimposed colored ink nozzle section 500(C), and a pass of the non-discharging nozzle section 500(E) involved with one main scanning operation of the head unit 12 is interposed between a pass of the metallic ink nozzle section 500(M) and a pass of the non-superimposed colored ink nozzle section 500(C).

With this, if the metallic ink layer and a layer formed with non-superimposed colored ink are adjacent to each other, the non-discharging nozzle section 500(E) passes above the metallic ink layer before the non-superimposed colored ink nozzle section 500(C) discharges ink at a boundary between the layers. The metallic ink layer can be dried during this time. Since the non-superimposed colored ink is discharged at the boundary after the printing medium 50 has been fed in the sub scanning direction, it is possible to suppress bleeding or blur that may occur at the boundary due to the undried metallic ink and non-superimposed colored ink coming into contact with each other, which deteriorates the image quality.

Furthermore, in the printer 10, a pass of the non-discharging nozzle section 500(E) that is involved with one main scanning operation of the head unit 12 is interposed between a pass of the superimposed colored ink nozzle section 400(MC) and a pass of the non-superimposed colored ink nozzle section 400(C).

With this, even if a layer formed with ink from the non-superimposed colored ink nozzle section 400(C), and a layer formed with ink from the superimposed colored ink nozzle section 400(MC) are adjacent to each other, a time period in which the ink discharged from the non-superimposed colored ink nozzle section 400(C) is dried can be ensured until the superimposed colored ink nozzle section 400(MC) discharges ink. Accordingly, it is possible to suppress ink bleed at a boundary between the layer formed with ink from the non-superimposed colored ink nozzle section 400(C) and the layer formed with ink from the superimposed colored ink nozzle section 400(MC), which deteriorates the image quality.

Furthermore, in the head unit 12 of the printer 10, the area of the metallic ink nozzle section 500(M) is smaller than area of the superimposed colored ink nozzle section 500(M).

Accordingly, by reducing the area of the metallic ink nozzle section 500(M) while maintaining the number of nozzle holes of the metallic ink nozzle section 500(M) and the superimposed colored ink nozzle section 500(MC) from which the respective types of ink are to be discharged, it is possible to increase the area of the superimposed colored ink nozzle section 500(MC) in accordance with this reduction. Accordingly, it is easy to increase the recording density of the metallic ink, and decrease the recording density of the superimposed colored ink.

Furthermore, the controller 22 (head controller) of the printer 10 controls ink discharge of the head unit 12 such that the superimposed colored ink nozzle section 100(MC) discharges the colored ink at the same time as the metallic ink nozzle section 100(M) discharges the metallic ink.

As a result of the metallic ink nozzle section 100(M) and the superimposed colored ink nozzle section 100(MC) discharge the ink at the same time, it is possible to form an image using a recording method for stepwise recording a region with a plurality of passes (so-called "multi-pass method"), although the region is able to be recorded with one pass of the head unit 12. The image can achieve the good image quality without bands that may occur between adjacent passes concentrating at one position (banding).

Furthermore, in a printing method of an embodiment according to the present invention, the head unit 12 is used that discharges ink onto the printing medium 50 while moving in the main scanning direction (Y direction in FIG. 2), and is provided with the metallic ink nozzle section 100(M) that discharges metallic ink for forming a metallic ink layer, the superimposed colored ink nozzle section 100(MC) that discharges superimposed colored ink that is to be superimposed on the metallic ink layer, and the non-superimposed colored ink nozzle section 100(C) that serves as a buffer section that does not discharge ink onto the metallic ink layer when the head unit 12 moving in the main scanning direction (Y direction in FIG. 2) passes above the metallic ink layer, and a pass of the non-superimposed colored ink nozzle section 100(C) is interposed between a pass of the metallic ink nozzle section 100(M) and a pass of the superimposed colored ink nozzle section 100(MC), the passes being involved with one main scanning operation of the pass head unit 12.

According to the above-described configuration, after the metallic ink layer has been formed, no ink is discharged onto the metallic ink layer while the non-superimposed colored ink nozzle section 100C passes by the position facing the metallic ink layer, and thus the metallic ink layer can be dried during this time.

The present invention is not limited to the above-described embodiments, and various modifications are possible within a scope defined by the claims, and the technical scope of the present invention encompasses embodiments that are obtained by appropriately combining technical means disclosed in different embodiments. Industrial Applicability The present invention is applicable to inkjet printing.

The invention claimed is:

1. A printer, comprising:

a head unit that is configured to move in a main scanning direction, and is provided with a plurality of ink discharging nozzles on a surface that faces a printing medium; and a movement controller that is configured to move at least one of the printing medium and the head unit so that the printing medium and the head unit move relatively to each other in a sub scanning direction that is orthogonal to the main scanning direction, wherein the plurality of ink discharging nozzles of the head unit are divided into at least:

a base ink nozzle section configured to discharge a base ink for forming a base layer on the printing medium when the head unit moves in the main scanning direction;

a superimposed ink nozzle section configured to discharge a superimposed ink that is to be superimposed on the base layer when the head unit passes above the base layer by moving in the main scanning direction; and a buffer section configured not to discharge an ink onto the base layer when the head unit passes above the base layer by moving in the main scanning direction, and the base ink nozzle section, the superimposed ink nozzle section, and the buffer section are arranged such that the buffer section passes above the base layer before the superimposed ink nozzle section passes above the base layer, wherein the buffer section includes a non-superimposed ink nozzle section configured to discharge the ink that is not to be superimposed on the base layer, the printer further comprises a head controller configured to control an ink discharge of the head unit, the head controller controls the non-superimposed ink nozzle section to discharge the ink, and at least one of the superimposed ink nozzle section and the non-superimposed ink nozzle section is configured to discharge an image forming ink.

2. The printer according to claim 1, wherein the base ink is glossy ink that contains glossy pigments and a solvent, and the head controller controls discharge of the base ink such that dots of the base ink that has been discharged from the base ink nozzle section onto the printing medium come into contact with each other.

3. The printer according to claim 2, wherein the head controller controls discharge of the superimposed ink such that dots of the superimposed ink that has been discharged from the superimposed ink nozzle section onto the base layer do not come into contact with each other.

4. The printer according to claim 2, wherein the head controller controls discharge of the superimposed ink and the base ink such that a recording density of the superimposed ink is lower than a recording density of the base ink.

5. The printer according to claim 1, wherein a number of ink discharging nozzles of the base ink nozzle section that are included in the main scanning direction is smaller than a number of ink discharging nozzles of the superimposed ink nozzle section that are included in the main scanning direction.

6. The printer according to claim 1, wherein the base ink nozzle section and the superimposed ink nozzle section of the head unit are set to be offset in the sub scanning direction, and the head controller controls ink discharge of the head unit such that the base ink nozzle section discharges the base ink at the same time as the superimposed ink nozzle section discharges the superimposed ink.

7. A printer, comprising:

a head unit that is configured to move in a main scanning direction, and is provided with a plurality of ink discharging nozzles on a surface that faces a printing medium; and a movement controller that is configured to move at least one of the printing medium and the head unit so that the printing medium and the head unit move relatively to each other in a sub scanning direction that is orthogonal to the main scanning direction, wherein the plurality of ink discharging nozzles of the head unit are divided into at least:

a base ink nozzle section configured to discharge a base ink for forming a base layer on the printing medium when the head unit moves in the main scanning direction;

a superimposed ink nozzle section configured to discharge a superimposed ink that is to be superimposed on the base layer when the head unit passes above the base layer by moving in the main scanning direction; and a buffer section configured not to discharge an ink onto the base layer when the head unit passes above the base layer by moving in the main scanning direction, and the base ink nozzle section, the superimposed ink nozzle section, and the buffer section are arranged such that the buffer section passes above the base layer before the superimposed ink nozzle section passes above the base layer, wherein the buffer section includes:

a non-discharging nozzle section configured not to discharge the ink; and a non-superimposed ink nozzle section configured to discharge the ink that is not to be superimposed on the base layer, and the non-discharging nozzle section is arranged to pass above the base layer before the superimposed ink nozzle section passes above the base layer.

8. The printer according to claim 7, wherein the non-discharging nozzle section is arranged to pass above the base layer between a time when the superimposed ink nozzle section passes above the base layer, and a time when the non-superimposed ink nozzle section passes above the base layer.

9. A printed material manufacturing method for manufacturing a printed material, comprising:

discharging an ink onto a printing medium from a plurality of ink discharging nozzles of a head unit that are provided on a surface that faces the printing medium, while the head unit moves in a main scanning direction, wherein the plurality of ink discharging nozzles are divided into at least:

a base ink nozzle section configured to discharge a base ink for forming a base layer on the printing medium when the head unit moves in the main scanning direction;

a superimposed ink nozzle section configured to discharge a superimposed ink that is to be superimposed on the base layer when the head unit passes above the base layer by moving in the main scanning direction; and a buffer section configured not to discharge the ink onto the base layer when the head unit passes above the base layer by moving in the main scanning direction, and the buffer section passes above the base layer before the superimposed ink nozzle section passes above the base layer, and wherein the buffer section includes a non-superimposed ink nozzle section which discharges the ink that is not to be superimposed on the base layer, the ink is discharged from the non-superimposed ink nozzle section, and an image forming ink is discharged by at least one of the superimposed ink nozzle section and the non-superimposed ink nozzle section.

* * * * *